US007958738B2

(12) United States Patent
Nelson

(10) Patent No.: US 7,958,738 B2
(45) Date of Patent: Jun. 14, 2011

(54) DIRECT EXPANSION AMMONIA REFRIGERATION SYSTEM AND A METHOD OF DIRECT EXPANSION AMMONIA REFRIGERATION

(75) Inventor: Bruce Ian Nelson, Colville, WA (US)

(73) Assignee: Colmac Coil Mfg., Inc., Colville, WA (US)

( * ) Notice: Subject to any disclaimer, the term of this patent is extended or adjusted under 35 U.S.C. 154(b) by 547 days.

(21) Appl. No.: 12/156,980

(22) Filed: Jun. 6, 2008

(65) Prior Publication Data

US 2009/0301112 A1 Dec. 10, 2009

(51) Int. Cl.
*F25B 15/00* (2006.01)

(52) U.S. Cl. ..... 62/112; 62/504; 62/509

(58) Field of Classification Search ..... 62/112, 62/498, 504, 509; 165/104.26, 302; 122/366
See application file for complete search history.

(56) References Cited

U.S. PATENT DOCUMENTS 4,196,504 A * 4/1980 Eastman ..... 29/890.032
4,280,337 A * 7/1981 Kemp ..... 62/470
4,577,468 A 3/1986 Nunn, Jr. et al.
4,586,344 A * 5/1986 Lutz et al. ..... 62/101
4,612,086 A 9/1986 Dominguez
4,825,661 A * 5/1989 Holtzapple et al. ..... 62/225
4,890,668 A 1/1990 Cima
4,903,761 A * 2/1990 Cima ..... 165/104.25
4,929,414 A * 5/1990 Leonard et al. ..... 419/2
5,189,885 A * 3/1993 Ni ..... 62/117
5,305,941 A * 4/1994 Kent et al. ..... 228/19
5,314,010 A * 5/1994 Sakaya et al. ..... 165/104.26
5,325,676 A * 7/1994 Meckler ..... 62/93
5,725,049 A * 3/1998 Swanson et al. ..... 165/104.26
6,018,958 A * 2/2000 Lingelbach et al. ..... 62/222
6,089,039 A * 7/2000 Yamauchi ..... 62/498
6,349,564 B1 * 2/2002 Lingelbach et al. ..... 62/510
6,467,301 B1 * 10/2002 Lingelbach et al. ..... 62/475
6,467,302 B1 * 10/2002 Lingelbach et al. ..... 62/503
6,629,432 B1 * 10/2003 Critoph ..... 62/480
2001/0027664 A1 * 10/2001 Ross ..... 62/513
2002/0124993 A1 * 9/2002 Nakano ..... 165/48.1
2006/0042274 A1 * 3/2006 Manole ..... 62/77
2006/0243426 A1 * 11/2006 Hsu ..... 165/104.26
2008/0125747 A1 * 5/2008 Prokop ..... 604/508

* cited by examiner

*Primary Examiner* — Mohammad Ali
(74) *Attorney, Agent, or Firm* — Paine Hamblen, LLP

(57) ABSTRACT

A direct expansion ammonia refrigeration system and a method of direct expansion ammonia refrigeration is described and which includes a source of liquid ammonia refrigerant which is delivered in fluid flowing relation to a plurality of evaporator tubes which incorporate wicking structures, and which through capillary action facilitated by the wicking structures are effective for drawing liquid ammonia refrigerant along the inside facing surface of the evaporator tubes so as to substantially reduce any stratified and/or wavy flow patterns of the liquid ammonia refrigerant within the evaporator tubes. The invention further includes a novel accumulator vessel and heat exchanger vessel which are coupled in fluid flowing relation relative to the direct expansion ammonia refrigeration system and which facilitate the removal of water from the ammonia refrigerant in order to enhance the operation of the direct expansion ammonia refrigeration system.

46 Claims, 13 Drawing Sheets

FLOW PATTERNS DURING EVAPORATION IN A SMOOTH INSIDE DIAMETER HORIZONTAL EVAPORATOR TUBE

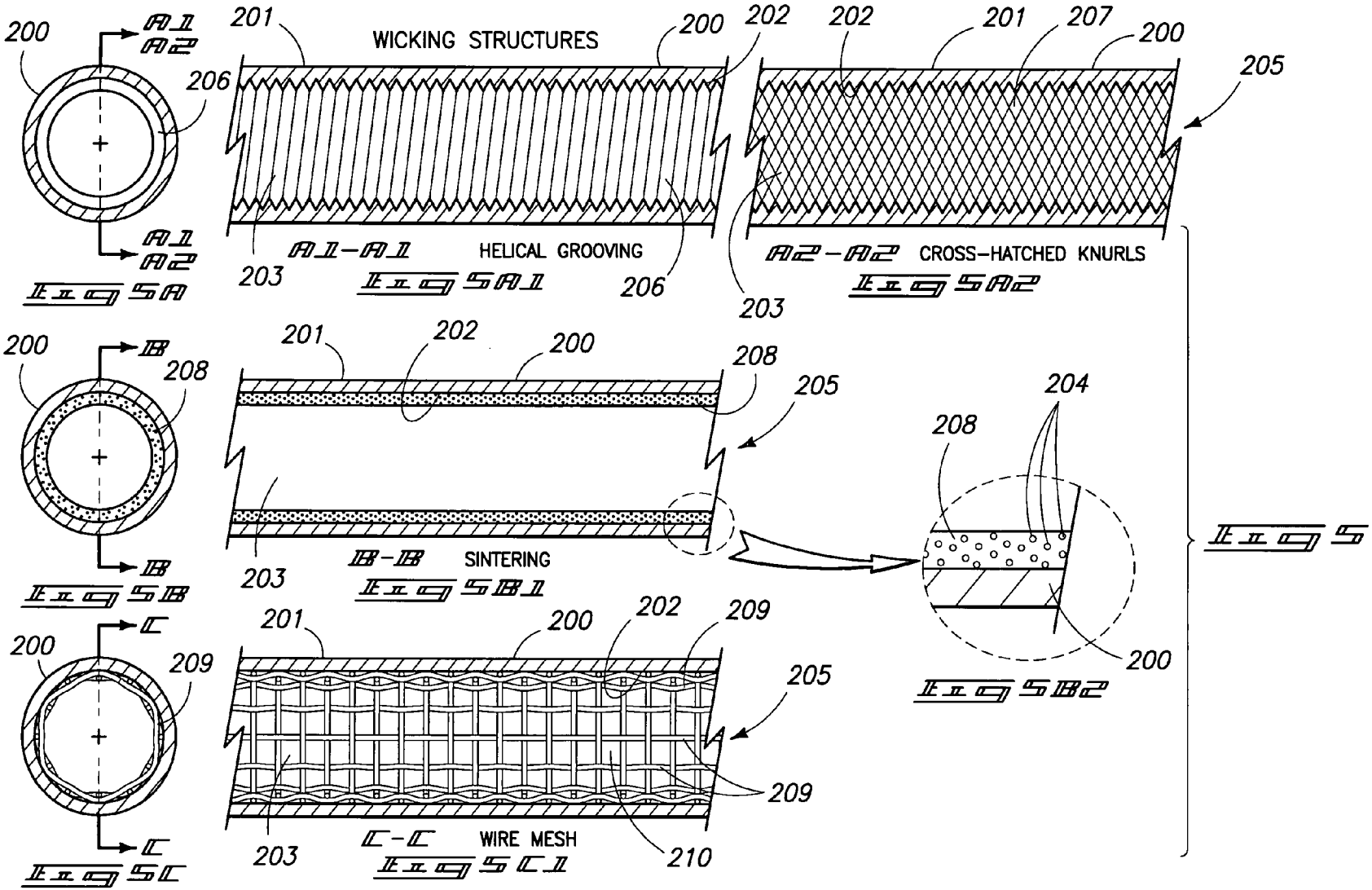
WICKING STRUCTURES
HELICAL GROOVING
CROSS-HATCHED KNURLS
SINTERING
WIRE MESH
200
201
202
203
204
205
206
207
208
209
210

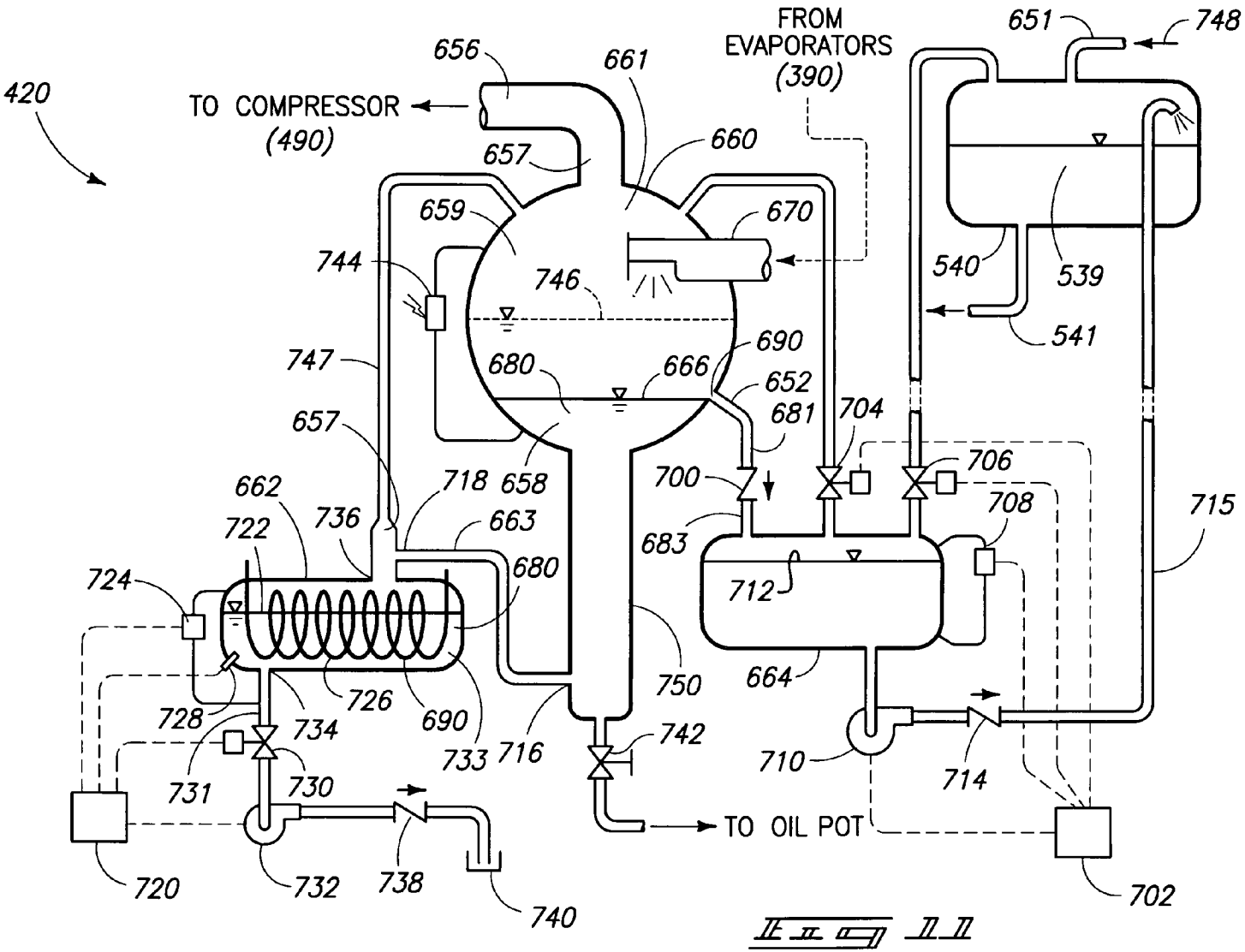
FROM EVAPORATORS (390)
TO COMPRESSOR (490)
TO OIL POT
II II

DIRECT EXPANSION AMMONIA REFRIGERATION SYSTEM AND A METHOD OF DIRECT EXPANSION AMMONIA REFRIGERATION

TECHNICAL FIELD

The present invention relates to a direct expansion ammonia refrigeration system and a method of direct expansion ammonia refrigeration system, and more specifically to a direct expansion ammonia refrigeration system employing evaporator tubes using a novel wicking structure, and an arrangement whereby any ammonia-water solution exiting an evaporator tube may be captured, and effectively removed from the direct expansion ammonia refrigeration system before it reaches and potentially damages a compressor which is utilized with the same system.

BACKGROUND OF THE INVENTION

The beneficial effects of employing ammonia as a working refrigerant in vapor compression refrigeration systems has been known since the late $19^{th}$ century. Those skilled in the art have recognized that ammonia has many advantages when utilized as a refrigerant. As a first matter, it has a high critical temperature; and secondly, a low triple point temperature which allows it to be applied over a wide range of applications. These applications include air conditioning applications where the air is maintained at temperatures greater than about 45 degrees F., to low temperature refrigeration applications where the air temperature must be maintained at temperatures at or below −40 degrees F. Ammonia has a latent heat of vaporization which is considered high and which reduces the mass flow required for any given refrigeration load. The direct result of this latent heat of vaporization is that for a given refrigeration load, the resulting liquid line sizes are relatively small. Still further, other thermodynamic and thermophysical properties of ammonia result in good heat transfer coefficients. This results in efficient and compact heat exchanger designs being employed in various applications.

Ammonia is also considered to be an environmentally friendly, or "green" refrigerant since it occurs in nature and has no known capacity for depleting ozone in the atmosphere. It further has no apparent global warming potential. Those skilled in the art recognize that ammonia is used widely in a number of industry segments and in various applications. Ammonia is relatively easy to produce and is low in cost as compared to other halo-carbon refrigerants now being employed.

While ammonia has been known for a long period of time and has many advantages, it also has some disadvantages which have detracted from its usefulness. Chief among its shortcomings is that ammonia is toxic in high concentrations; is an irritant in low concentrations; and further has a very pungent order when released. Still further, ammonia is flammable in a narrow range of concentrations with air. Another serious shortcoming with ammonia is that ammonia has a significant affinity for water. Ammonia readily reacts with any water which may inadvertently get introduced to a refrigeration system and thereafter holds the water tightly in solution. In the prior art ammonia refrigeration systems utilized heretofore, water has always been considered a contaminant. It has been known that it is extremely difficult to keep water out of a prior art ammonia refrigeration system. Unfortunately, even in small amounts, an aqueous ammonia refrigerant can significantly increase the boiling point of the refrigerant mixture resulting in reduced refrigeration system performance, and increased operating costs. Typically, the presence of only a small amount of water in the prior art ammonia refrigeration system, employed heretofore, will typically cause an expansion valve control function to fail. If this failure is left unintended the ever increasing concentration of water in the refrigerant increases the boiling point of the ammonia-water concentration until the expansion valve controller is no longer able to sense the correct amount of superheat in any resulting refrigerant vapor. If left uncorrected, this same ammonia-water refrigerant can ultimately irreparably damage a compressor employed with the same refrigeration system.

Heretofore, industrial ammonia evaporators employed with prior art refrigeration systems have been typically fed with liquid refrigerant in one of several ways. These ways have included gravity flooding; liquid overfeed; and direct or dry expansion. With respect to both prior art gravity flooding, and liquid overfeed ammonia refrigeration systems, these systems require relatively large inventories of liquid ammonia refrigerant circulating between various vessels, and the evaporators employed with these systems. On the other hand, direct expansion ammonia refrigeration systems operate with the smallest amount of ammonia refrigerant inventory possible. In view of the aforementioned advantages, and disadvantages, of ammonia refrigerant discussed, above, direct expansion ammonia refrigeration systems have become quite attractive, at a number of different levels, for the owners and operators of these same systems. For example, the ability to operate with a low ammonia refrigerant charge in a refrigeration system is desirable because, as a first matter, this reduces the cost of manufacturing these same systems by allowing for the elimination of pressure vessels, pumps and the reduction of liquid line sizes. Secondly, direct expansion ammonia refrigeration systems are attractive because of their reduced risk of fire or explosion. Still further, they present reduced risks should an ammonia leak occur. Additionally, because of these reduced risks of system damage or worker injury because of the smaller amount of ammonia refrigerant being used, owners of such systems may experience a lower insurance rate and further reduced EPA and OSHA health and safety requirements for installing and operating such systems.

Not with standing these many advantages, an efficient and highly effective direct expansion ammonia refrigeration system has proved elusive to designers. Prior art direct expansion ammonia refrigeration systems have continued to suffer from poor evaporator performance caused by undesirable two phase flow patterns of the ammonia refrigerant in the evaporator tubes, from malfunctioning thermostatic expansion valves, and the consequent damage to compressors resulting from the return of ammonia-water solutions to the compressors caused by the effects noted, above. Consequently, owners and operators of prior art ammonia refrigeration systems have had to live, heretofore, with larger ammonia refrigerant inventories associated with gravity flooded and pump recirculated arrangements as will be described in greater detail hereinafter.

OBJECTS AND SUMMARY OF THE INVENTION

Therefore, a first aspect of the present invention relates to a direct expansion ammonia refrigeration system which includes a source of liquid ammonia refrigerant; and an evaporator tube coupled in fluid receiving relation relative to the source of liquid ammonia refrigerant, and which has an inside facing surface having a wicking structure, and wherein capillary action, facilitated by the wicking structure, draws the liquid ammonia refrigerant along the inside facing surface of the evaporator tube so as to substantially reduce any stratified and/or wavy flow patterns of the liquid ammonia refrigerant within the evaporator tube.

Another aspect of the present invention relates to a direct expansion ammonia refrigeration system which includes a source of liquid ammonia refrigerant; a direct expansion ammonia evaporator; a compressor which is coupled in fluid flowing relation relative to the source of liquid ammonia refrigerant, and which provides the liquid ammonia refrigerant to the direct expansion ammonia evaporator; an accumulator vessel defining an internal cavity having a liquid region, and a vapor region, and wherein the vapor region is coupled in fluid receiving relation relative to the direct expansion ammonia evaporator, and in fluid delivering relation relative to the compressor, and wherein the liquid region contains aqueous liquid ammonia received from the evaporator; and a heat exchanger vessel coupled in fluid receiving relation relative to the liquid region of the accumulator vessel, and in fluid delivering relation relative to the vapor region of the accumulator vessel, and wherein the heat exchanger vessel includes a heating element which vaporizes the aqueous liquid ammonia so as to deliver substantially dry ammonia vapor to the vapor region of the accumulator vessel, and wherein the substantially dry ammonia vapor is subsequently delivered to the compressor.

Still another aspect of the present invention relates to a direct expansion ammonia refrigeration system which includes a source of liquid ammonia refrigerant; a direct expansion ammonia evaporator which has a plurality of evaporator tubes, and which are coupled in fluid flowing relation relative to the source of liquid ammonia refrigerant; a compressor which provides the source of liquid ammonia refrigerant under pressure to the direct expansion ammonia evaporator; an accumulator vessel defining an internal cavity which has a liquid region; and a vapor region, which is coupled in downstream fluid flowing relation relative to the direct expansion ammonia evaporator, and which is further coupled in upstream fluid flowing relation relative to the compressor, and wherein the liquid region contains aqueous liquid ammonia received from the evaporator, and wherein the liquid and vapor regions of the accumulator vessel are defined, one relative to the other, by an aqueous liquid ammonia level, and wherein the accumulator vessel has a minimum aqueous liquid ammonia level, and a maximum aqueous liquid ammonia level; a heat exchanger vessel coupled in downstream fluid flowing relation relative to the liquid region of the accumulator vessel, and which is further coupled in upstream fluid flowing relation relative to the vapor region of the accumulator vessel, and wherein the heat exchanger vessel comprises a heating element which vaporizes at least some of the aqueous liquid ammonia so as to deliver substantially dry ammonia vapor to the vapor region of the accumulator vessel, and a remaining acceptably concentrated aqueous ammonia byproduct, and wherein the substantially dry ammonia vapor is subsequently delivered to the compressor; a first fluid conduit having a first end, and a second end, and wherein the first end is coupled in fluid flowing relation relative to the liquid region of the accumulator vessel, and the second end is coupled in fluid flowing relation relative to the heat exchanger vessel, and wherein the first end is positioned at an elevation below the heat exchanger vessel, and the second end is positioned at an elevation above the heat exchanger vessel; a liquid transfer vessel coupled in fluid flowing relation relative to the accumulator vessel, and which regulates the aqueous liquid ammonia level of the accumulator vessel; a second fluid conduit having a first end coupled in fluid flowing relation relative to the accumulator vessel, and a second end coupled in fluid flowing relation relative to the liquid transfer vessel, and wherein the first end is positioned above the minimum aqueous liquid ammonia level, and below the maximum aqueous liquid ammonia level of the accumulator vessel; a high pressure receiver vessel which is coupled in fluid flowing relation relative to the liquid transfer vessel; a plurality of solenoid valves positioned in fluid metering relation therebetween the accumulator vessel, and the liquid transfer vessel, and between the liquid transfer vessel and the high pressure receiver; and a controller for controlling the operation of the plurality of solenoid valves so as to regulate the aqueous liquid ammonia level of the accumulator vessel.

Yet still another aspect of the present invention relates to a direct expansion ammonia refrigerant system which includes a source of a substantially non-aqueous liquid ammonia refrigerant; a direct expansion ammonia evaporator having a plurality of evaporator tubes coupled in sequential gravity-feeding relation one relative to the others, and in fluid receiving relation relative to the source of liquid ammonia refrigerant, and wherein each of the evaporator tubes has an inside facing surface which defines individual refrigerant passageways, and wherein the inside facing surface of at least one of the plurality evaporator tubes incorporates a wicking structure within the refrigerant passageway, and which, by capillary action, effectively draws, at least in part, the liquid ammonia refrigerant entering the refrigerant passageway along the inside facing surface so as to reduce any stratified and/or wavy flow patterns of the liquid ammonia refrigerant as it moves within the at least one of the plurality of evaporator tubes, and wherein the substantially non-aqueous liquid ammonia refrigerant leaves the respective evaporator tubes as substantially aqueous liquid ammonia and/or ammonia vapor; an accumulator vessel defining an internal cavity, and which has a liquid region, and a vapor region, and wherein the vapor region further defines a fluid intake which is coupled in fluid receiving relation relative to the plurality of evaporator tubes, and wherein the liquid region receives and contains the aqueous liquid ammonia received from the plurality of evaporator tubes; a heat exchanger vessel coupled in fluid receiving relation relative to the liquid region of the accumulator vessel, and is further coupled in fluid delivering relation relative to the vapor region of the accumulator vessel, and wherein the heat exchanger vessel includes a heating element which, when energized, vaporizes the aqueous liquid ammonia so as to deliver a substantially dry ammonia vapor to the vapor region of the accumulator vessel, and produce an acceptably concentrated aqueous ammonia byproduct; and a compressor coupled in fluid receiving relation relative to the vapor region of the accumulator vessel, and in fluid delivering relation relative to the plurality of evaporator tubes, and wherein the substantially dry ammonia vapor from the vapor region of the accumulator vessel is delivered to the compressor for conversion back to a substantially non-aqueous liquid ammonia refrigerant, and wherein the compressor provides the source of the substantially non-aqueous liquid ammonia refrigerant to the direct expansion ammonia evaporator.

Moreover, another aspect of the present invention relates to a method of direct expansion ammonia refrigeration which includes the steps of providing a source of a substantially non-aqueous liquid ammonia refrigerant; providing a liquid ammonia expansion evaporator which has a plurality of evaporator tubes coupled in fluid receiving relation relative to the source of refrigerant, and wherein each of the plurality of evaporator tubes has an inside facing surface which has a wicking structure; and drawing the liquid ammonia refrigerant up onto the inside facing surface of the evaporator tube by capillary action by employing the wicking structure.

Yet another aspect of the present invention relates to a method of direct expansion ammonia refrigeration which includes the steps of providing a source of a substantially non-aqueous liquid ammonia; providing a liquid ammonia expansion evaporator; supplying the source of substantially non-aqueous liquid ammonia to the liquid ammonia expansion evaporator; providing a compressor coupled in upstream fluid flowing relation relative to the liquid ammonia expansion evaporator, and in downstream fluid flowing relation relative to the source of the substantially non-aqueous liquid ammonia; providing an accumulator vessel defining an internal cavity with a liquid region and a vapor region, and wherein the vapor region is coupled in downstream fluid flowing relation relative to the direct expansion ammonia evaporator, and is further coupled in upstream fluid flowing relation relative to the compressor; providing a heat exchanger vessel coupled in downstream fluid flowing relation relative to the liquid region of the accumulator vessel, and in upstream fluid flowing relation relative to the vapor region of the accumulator vessel, and wherein the heat exchanger vessel further includes a heating element; collecting any aqueous liquid ammonia and any ammonia vapor from the liquid ammonia expansion evaporator into the accumulator vessel, and wherein the ammonia vapor collects in the vapor region of the accumulator vessel, and the aqueous liquid ammonia collects in the liquid region of the accumulator vessel; transferring the aqueous liquid ammonia from the liquid region of the accumulator vessel to the heat exchanger vessel; heating the aqueous liquid ammonia in the heat exchanger vessel to vaporize at least some of the liquid ammonia, and producing a substantially dry ammonia vapor, while leaving an acceptably concentrated aqueous ammonia byproduct in the heat exchanger vessel; returning the substantially dry vaporized ammonia to the vapor region of the accumulator vessel; and delivering the substantially dry vaporized ammonia from the vapor region of the accumulator vessel to the compressor.

Still another aspect of the present invention relates to a method of direct expansion ammonia refrigeration which includes the steps of a) providing a source of a substantially non-aqueous liquid ammonia refrigerant; b) providing a liquid ammonia expansion evaporator, which has a plurality of evaporator tubes coupled in fluid flowing relation relative to the source of the substantially non-aqueous liquid ammonia refrigerant, and wherein each of the plurality of evaporator tubes has an inside facing surface which has a wicking structure; c) supplying the substantially non-aqueous liquid ammonia refrigerant to the plurality of evaporator tubes; d) drawing the substantially non-aqueous liquid ammonia refrigerant up onto the inside facing surface of the respective evaporator tubes with capillary action which is facilitated by the wicking structure; e) boiling the substantially non-aqueous liquid ammonia refrigerant within the respective evaporator tubes to produce aqueous liquid ammonia refrigerant and/or ammonia refrigerant vapor; f) providing a compressor coupled in upstream fluid flowing relation relative to the liquid ammonia expansion evaporator, and which supplies the substantially non-aqueous liquid ammonia refrigerant to the plurality of evaporator tubes; g) providing an accumulator vessel defining an internal cavity with a liquid region and a vapor region, and wherein the vapor region is coupled in downstream fluid flowing relation relative to the direct expansion ammonia evaporator, and is further coupled in upstream fluid flowing relation relative to the compressor; h) providing a heat exchanger vessel coupled in fluid receiving relation relative to the liquid region of the accumulator vessel, and which is further coupled in fluid delivering relation relative to the vapor region of the accumulator vessel, and wherein the heat exchanger vessel includes a heating element; i) collecting any aqueous liquid ammonia and/or any ammonia vapor from the liquid ammonia expansion evaporator into the accumulator vessel, and wherein the ammonia vapor collects in the vapor region of the accumulator vessel, and the aqueous liquid ammonia collects in the liquid region of the accumulator vessel; j) transferring the aqueous liquid ammonia from the liquid region of the accumulator vessel to the heat exchanger vessel; k) energizing the heating element so as to heat the aqueous liquid ammonia in the heat exchanger vessel and to vaporize at least some of the liquid ammonia to form substantially dry ammonia vapor while leaving an acceptably concentrated aqueous ammonia liquid byproduct in the heat exchanger vessel; l) returning the substantially dry ammonia vapor to the vapor region of the accumulator vessel; m) supplying the substantially dry ammonia vapor received in the vapor region of the accumulator vessel to the compressor so as to be subsequently converted to substantially non-aqueous liquid ammonia refrigerant; and n) repeating steps c through k.

These and other aspects of the present invention will be described in greater detail hereinafter.

BRIEF DESCRIPTION OF THE DRAWINGS

Preferred embodiments of the invention are described below with reference to the following accompanying drawings.

FIGS. 4A-4E are transverse, vertical, sectional views taken from various positions along lines 4A-4A, 4B-4B, 4C-4C, 4D-4D, and 4E-4E as seen in FIG. 4.

FIG. 5 shows four exemplary and non-limiting embodiments of wicking structures forming a feature of the present invention.

FIG. 5A is a transverse, vertical, sectional view taken through one form of an evaporator tube finding usefulness in the present invention.

FIG. 5A1 is a longitudinal, vertical, sectional view taken from a position along lines A1-A1 of FIG. 5A.

FIG. 5A2 is a longitudinal, vertical, sectional view taken from a position along lines A2-A2 of FIG. 5A.

FIG. 5B is a transverse, vertical, sectional view taken through another form of an evaporator tube finding usefulness in the present invention.

FIG. 5B1 is a longitudinal, vertical, sectional view taken from a position along lines B-B of FIG. 5B.

FIG. 5B2 is a greatly exaggerated fanciful depiction of a portion of the structure as seen in FIG. 5B1 as indicated by the arrow.

FIG. 5C is a transverse, vertical, sectional view of yet another form of an evaporator tube finding usefulness in the present invention.

FIG. 5C1 is a longitudinal, vertical, sectional view taken from a position along lines C-C of FIG. 5C.

FIG. 6 is a graphical depiction showing the bubble point temperature of liquid ammonia refrigerant when combined with various concentrations of water.

FIG. 7 is a graphical depiction showing the increase in the bubble point temperature of ammonia versus ammonia vapor quality at a 3% water concentration as calculated at a temperature of saturation of −40 degrees F.

FIG. 8 is a graphical depiction showing the concentration of water remaining in liquid versus the ammonia vapor quality. This is calculated at a 3% concentration of water with ammonia at an initial temperature of saturation of −40 degrees F.

FIG. 10 is a greatly simplified, schematic view of one form of the direct expansion ammonia refrigeration system of the present invention.

FIG. 13 is a greatly simplified schematic view depicting the evaporator refrigerant circulation pattern as provided with an evaporator having horizontal air flow of the present invention.

FIG. 14 shows a second form of an evaporator refrigerant circulation pattern for an evaporator having vertical air flow of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Referring more specifically to the drawings, the present invention provides a novel means, as will be discussed in greater detail hereinafter, for mitigating the poor evaporator performance which has been experienced in prior art direct expansion ammonia refrigeration systems which have been used heretofore. Without being confined to any particular theory, it is believed that poor evaporator performance appears to have been caused, at least in part, by stratified-wavy two phase flow patterns of refrigerant in the evaporator tubes as will be discussed hereinafter; and the continuous removal of water from an ammonia refrigerant which is used in a direct expansion ammonia refrigeration system as will be described and discussed in detail in FIGS. 5-14, respectively. As discussed earlier in the background section of the present invention, it has long been known that even small amounts of water in solution with ammonia will significantly increase the boiling point of the liquid ammonia refrigerant employed in a direct expansion ammonia refrigeration system such that the prior art thermostatic expansion valves cannot correctly sense the correct superheat in the refrigerant vapor leaving the evaporator which has been employed with same. Please see FIGS. 6-9. The result of a malfunctioning thermostatic expansion valve in prior art systems has resulted in a significant amount of water-rich refrigerant solution which increasingly collects in an evaporator employed with such prior art direct expansion ammonia refrigeration systems utilized, heretofore. This ammonia-water refrigerant mixture, as discussed, has had the effect of reducing the performance of such direct expansion ammonia evaporation systems (FIGS. 6-9) and further, if supplied to a compressor used with such systems may ultimately result in a mechanical failure of the compressor, thus increasing the cost of operation of such refrigeration systems.

Figure 1:
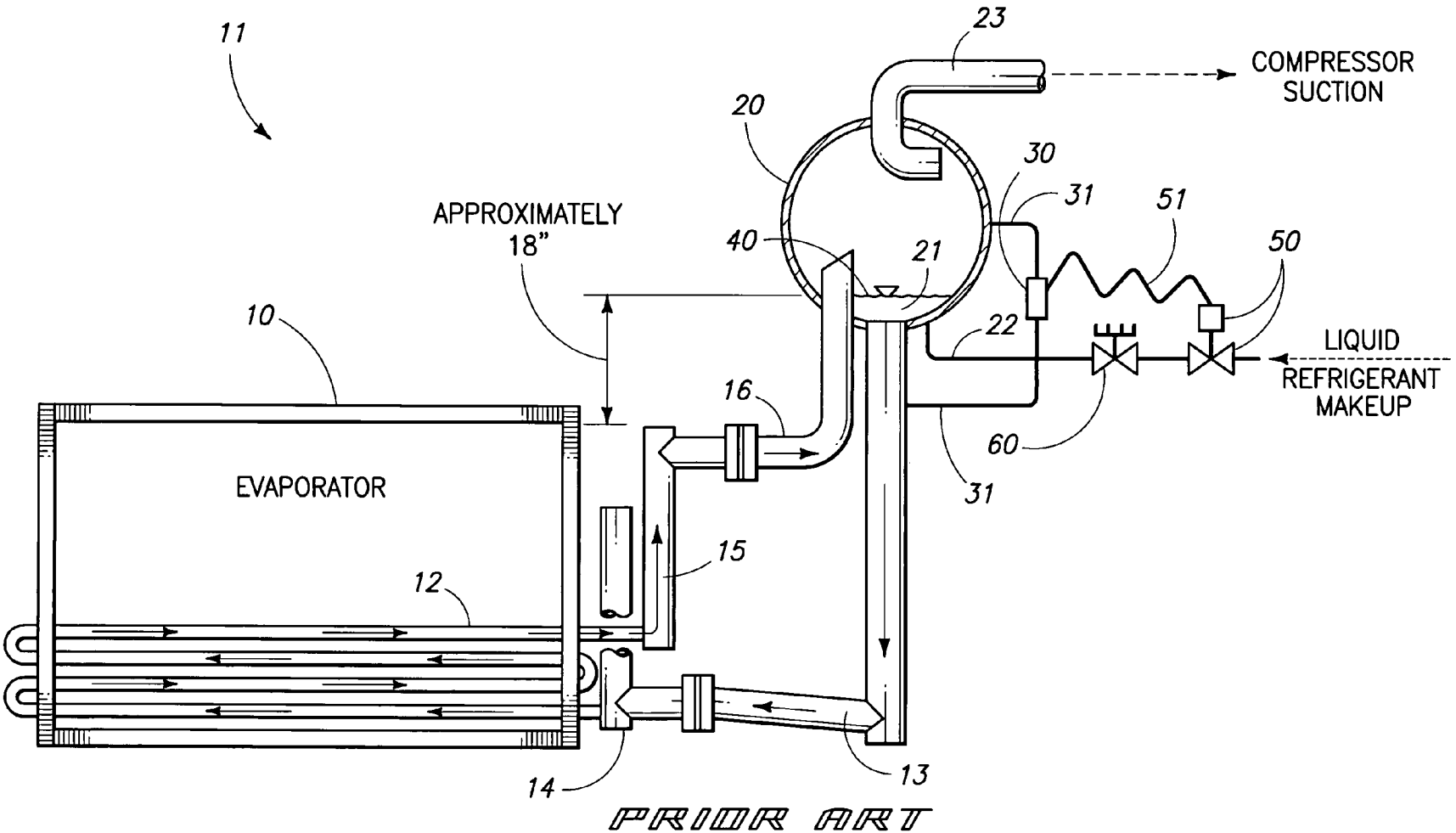
PRIOR ART FIG 1
FIG. 1 is a highly simplified transverse, vertical, sectional view with some surfaces removed of a prior art gravity flooded evaporator employed with a prior art ammonia refrigeration system.
Figure 4:
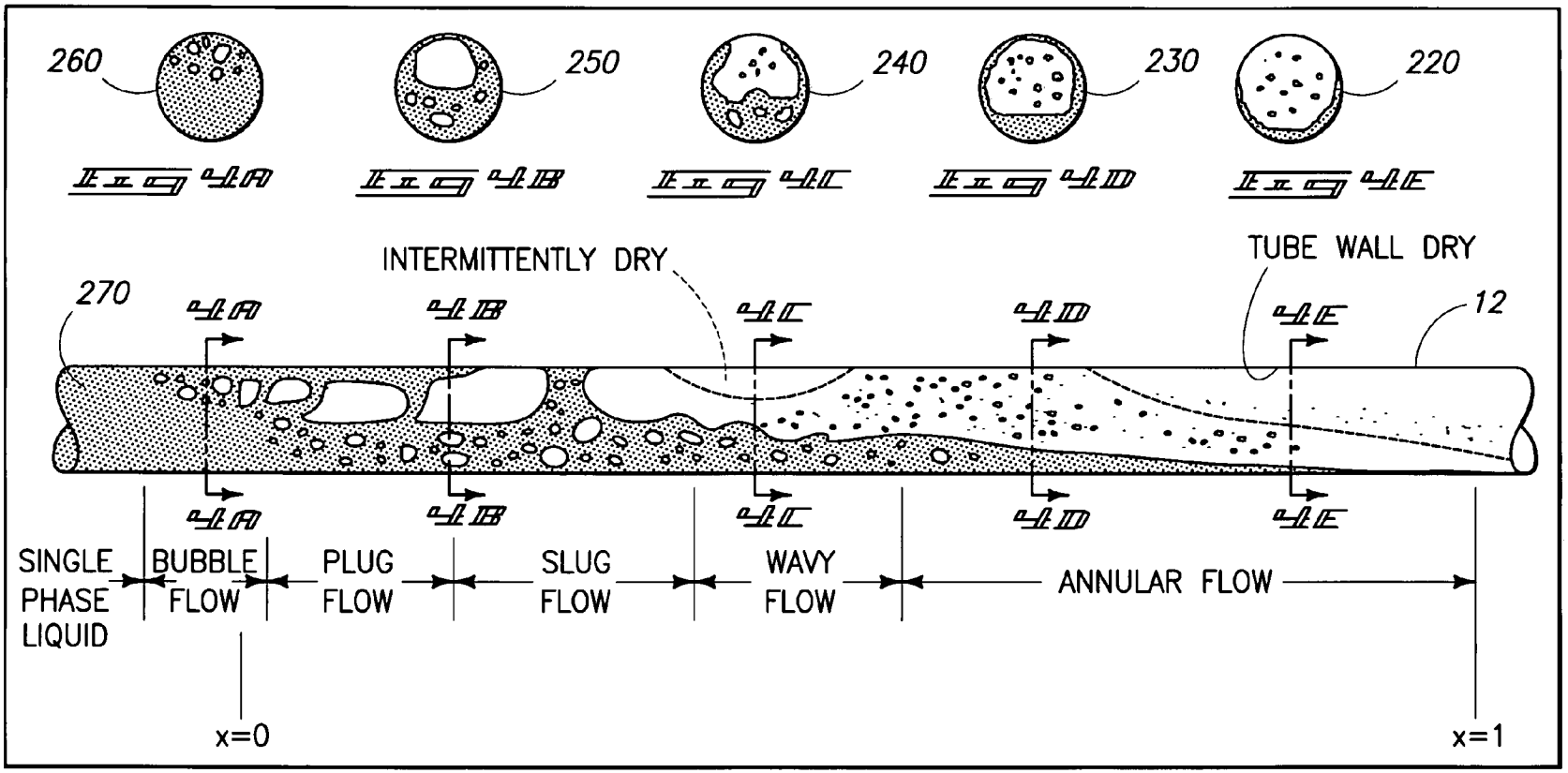
PRIOR ART FIG 4
FIG. 4 is a longitudinal, vertical, sectional view taken through a prior art smooth inside diameter horizontal evaporator tube showing the refrigerant flow patterns exhibited by same.

Referring now to FIG. 1, a prior art gravity flooded evaporator 10 as employed in a prior art gravity flooded ammonia refrigeration system (not shown) is generally indicated by the numeral 11. The evaporator 10 as seen in FIG. 1 includes a plurality of evaporator tubes having smooth inside walls, and which are generally indicated by the numeral 12. The evaporator 10 is coupled in fluid flowing relation relative to a supply conduit 13. The supply conduit 13 is coupled in fluid flowing relation relative to an intake or supply manifold 14 which, in turn, supplies liquid ammonia refrigerant 21 to the lowest point in the evaporator 10. Still further, it will be seen that the prior art arrangement of FIG. 1 includes an exhaust manifold 15 which is coupled in downstream fluid flowing relation relative to each of the plurality of evaporator tubes 12. The exhaust manifold 15 is coupled in fluid flowing relation to a return conduit 16, and which is further coupled in fluid flowing relation relative to a surge drum/container 20. The surge drum container contains a quantity of liquid ammonia refrigerant generally indicated by the numeral 21. The liquid ammonia refrigerant 21 is supplied to the surge container 20 by means of a liquid refrigerant makeup conduit which is generally indicated by the numeral 22. Still further, a suction conduit, which is generally indicated by the numeral 23, is coupled in fluid flowing relation relative to the surge drum or container 20. A compressor suction which is provided to same causes the liquid ammonia refrigerant 21 to move along the supply conduit 13, and into the plurality of evaporator tubes 12, where the liquid ammonia refrigerant then boils or otherwise evaporates therein as seen in FIG. 4 and which will be discussed in greater detail hereinafter. In the arrangement as seen in FIG. 1, a liquid level switch 30 is provided and which is coupled by electrical conduits 31 to both the supply conduit 13, as well as a given location on the surge drum/container 20 in order to detect the relative level of the liquid ammonia refrigerant 40. Positioned in appropriate metering relation along the liquid refrigerant makeup conduit 22 is a hand-operated expansion valve 60 of conventional design. Still further, as seen in FIG. 1, a liquid level solenoid valve 50 is provided, and which is positioned in selective fluid metering relation along the same conduit. The liquid level solenoid valve 50 is connected by means of an electrical conduit 51 to the liquid level switch 30. The liquid level switch 30 is effective so as to control the liquid level solenoid valve 50, and allow liquid ammonia refrigerant makeup to be delivered to the surge drum/container 20. The hand-operated expansion valve 60 as shown is typically manually set to meter the approximate required amount of refrigerant to the evaporator. In the arrangement as seen in FIG. 1, it should be noted that the level 40 of the ammonia refrigerant 22 is approximately 18 inches higher than the top of the evaporator 20.

Figure 2:
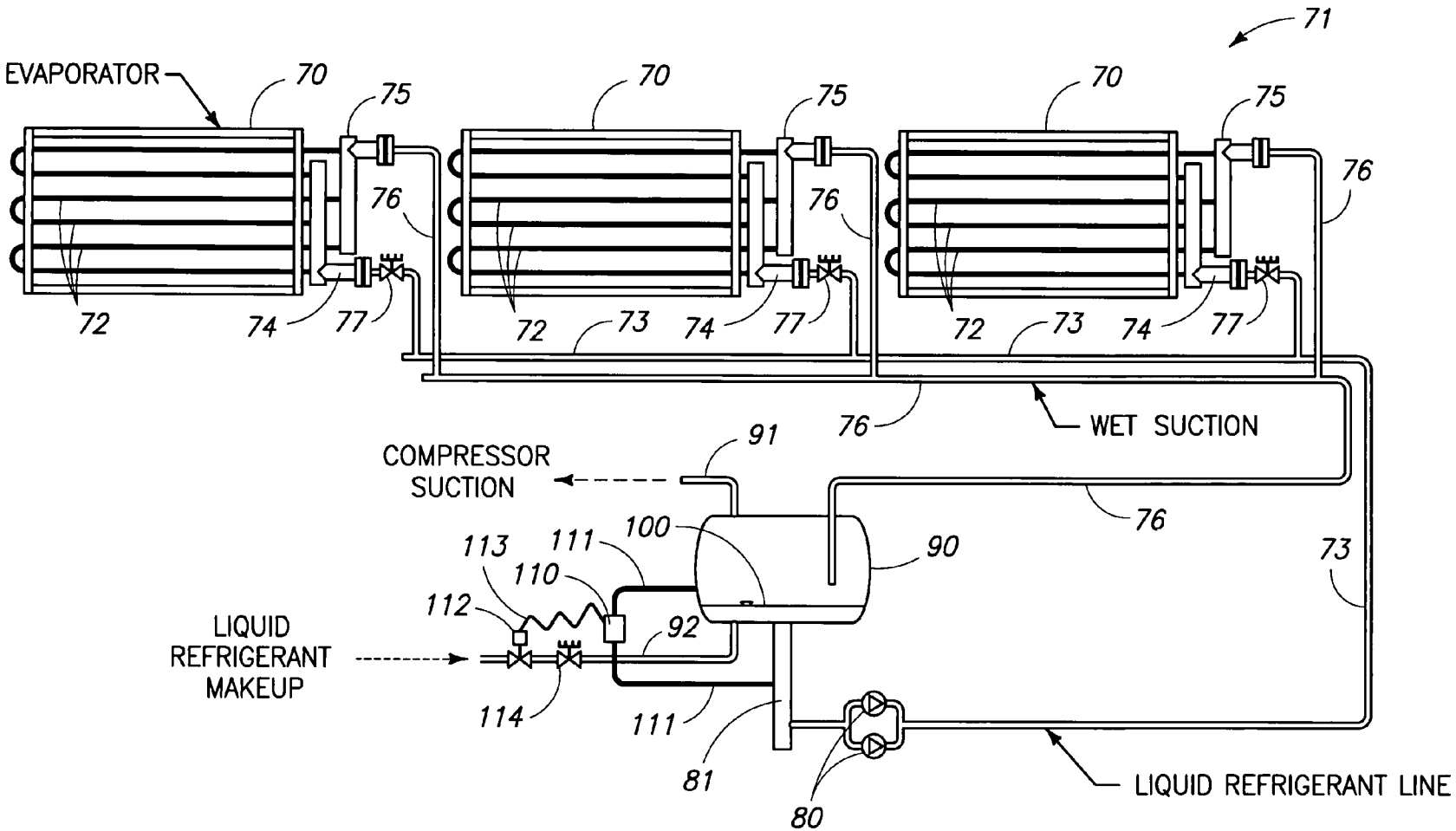
PRIOR ART FIG 2
FIG. 2 is a greatly simplified, transverse, vertical, sectional view of a prior art liquid overfeed evaporator arrangement employed with a prior art liquid ammonia refrigeration system.

Referring now to FIG. 2, a second, prior art, liquid overfeed ammonia refrigeration system is shown. The system, which is generally indicated by the numeral 71, includes a plurality of evaporators 70 which are of similar construction to that seen with respect to FIG. 1. In this regard, the plurality of evaporators 70 each include a plurality of evaporator tubes generally indicated by the numeral 72, and which have smooth inside walls. The evaporator tubes are connected in fluid flowing relation relative to a supply conduit which is generally indicated by the numeral 73. The supply conduit 73 is operable to supply liquid ammonia refrigerant, as described, below, to the respective evaporators. Again, each of the plurality of evaporators 70 includes an intake manifold 74 which is coupled to the respective supply conduits 73, and which further supplies the liquid ammonia refrigerant to the respective evaporator tubes 72 where the liquid ammonia refrigerant evaporates or otherwise boils as will be described in greater detail below. Still further, each of the plurality of evaporators 70 is coupled in fluid flowing relation to an exhaust manifold 75. The exhaust manifold 75 is, in turn, coupled in fluid flowing relation relative to a return conduit 76 which is also labeled "wet suction." As seen from FIG. 2, a first hand-operated expansion valve 77 is provided and which selectively meters the liquid ammonia refrigerant, as described below, to each of the plurality of evaporators 70. As illustrated in FIG. 2, a plurality of refrigerant pumps 80 are mounted in fluid supplying relation relative to the supply conduit 73. The respective plurality of pumps are coupled in fluid flowing relation relative to a liquid supply leg 81 of a low pressure receiving vessel 90. The liquid supply leg is in gravity receiving relation relative to the low pressure receiving vessel 90. The low pressure receiving vessel 90 contains a quantity of liquid ammonia refrigerant which is generally indicated by a liquid level 100. In this arrangement, the liquid ammonia refrigerant, under the influence of gravity, moves through the liquid supply leg 81 and then enters the supply conduit 73 where it is pumped, under pressure, by the plurality of refrigerant pumps 80, to the respective evaporators 70. As can be seen, the low pressure receiving vessel 90 is coupled in fluid receiving relation relative to the return or wet suction conduit 76. Still further, it will be seen that a compressor conduit 91 is coupled in fluid flowing relation to the low pressure receiving vessel 90. A compressor (not shown) is operable to remove pressure from the low pressure receiving vessel 90. Liquid ammonia refrigerant is supplied to the low pressure receiving vessel 90 by means of a liquid refrigerant makeup conduit which is generally indicated by the numeral 92. Still further, the liquid ammonia refrigerant level 100 within the low pressure receiving vessel 90 is maintained by means of a liquid level control which is generally indicated by the numeral 110. The liquid level control 110 is coupled to individual conduits 111, and is operable, when appropriately controlled, to maintain the liquid ammonia refrigerant level 100 within a given range. As illustrated in FIG. 2, a liquid level solenoid valve 112 is electrically coupled by means of an electrical conduit 113 to the liquid level control 110. The liquid level solenoid valve is positioned in selective fluid metering relation there along the liquid refrigerant makeup conduit 92. Still further, a second hand-operated expansion valve 114 is positioned in metering relation there along the liquid refrigerant makeup conduit 92. Again, it should be understood that the individual hand-operated expansion valves 77 and 114, respectively, are manually set to meter the approximate required amount of refrigerant required by the evaporators 70. It will be appreciated that the vacuum produced by the compressor suction on the low pressure receiving vessel 90 is operable to draw ammonia refrigerant exiting the respective evaporators 70 back to the low pressure receiving vessel 90.

Figure 3:
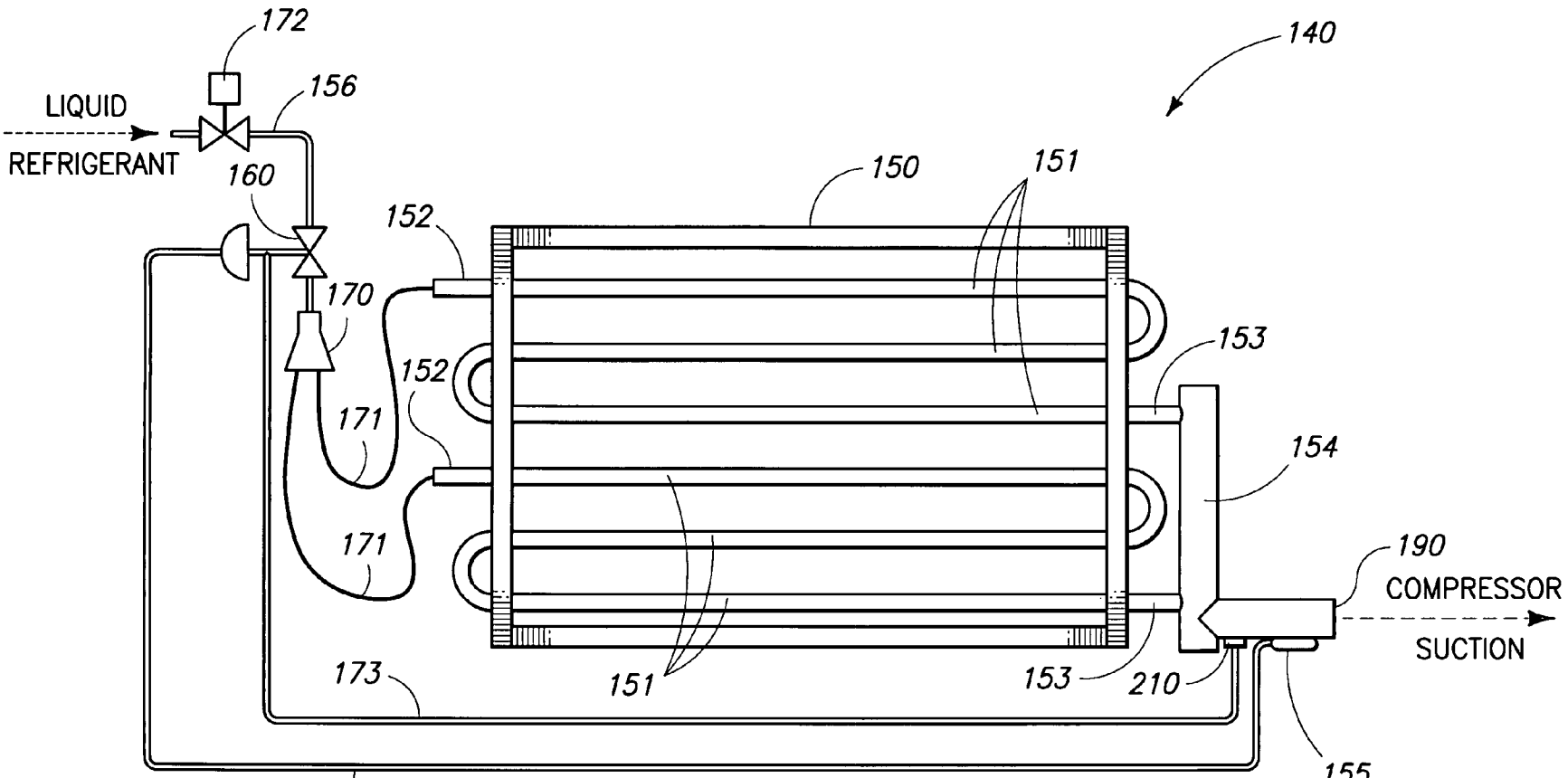
PRIOR ART FIG 3
FIG. 3 is a partial, greatly simplified illustration of an evaporator arrangement as used in a prior art direct expansion ammonia refrigeration system.

Referring now to FIG. 3, a portion of a prior art direct expansion ammonia refrigeration system is generally indicated by the numeral 140, therein. As seen in that drawing, the portion of the system 140 includes an evaporator which is generally indicated by the numeral 150. The evaporator comprises a plurality of evaporator tubes 151. Each of the plurality of evaporator tubes 151 have an intake end 152 and an opposite exhaust end which is generally indicated by the numeral 153. The evaporator tubes all have a smooth interior facing surface. The exhaust ends 153 are each coupled in fluid flowing relation relative to an exhaust manifold which is generally indicated by the numeral 154. The exhaust manifold 154 experiences a vacuum or suction as provided by a compressor (not shown) as indicated in the drawing. As seen in FIG. 3, a temperature sensor which is generally indicated by the numeral 155 is located in close proximity to the exhaust manifold 154. Still further, as seen in FIG. 2, a liquid refrigerant supply line 156 is coupled in fluid flowing relation relative to the intake ends 152 of the respective plurality of evaporators 151. As seen in FIG. 3, a thermostatically controlled expansion valve which is generally indicated by the numeral 160 is positioned in selective fluid metering relation there along the liquid refrigerant supply line 156. Still further, and positioned downstream relative to the thermostatically controlled expansion valve 160 is a distributor 170 of conventional design. The distributor 170 couples a source of liquid ammonia refrigerant which is traveling along the liquid refrigerant supply line 156 with the intake ends 152 of the plurality of evaporator tubes 151 by means of a plurality of supply leads which are generally indicated by the numeral 171. A liquid level solenoid valve which is generally indicated by the numeral 172 is positioned upstream relative to the thermostatically controlled expansion valve 160 and meters liquid ammonia refrigerant to the thermostatically controlled expansion valve 160. Still further, as seen in FIG. 3, a pressure equalizer conduit 173 extends between a position which is slightly downstream relative to the exhaust manifold 154 and into fluid flowing contact relative to the thermostatically controlled expansion valve 160. Still further, a temperature control capillary tube 174 extends therebetween the temperature sensor 155 and the thermostatically controlled expansion valve 160 in order to facilitate the control of same.

The arrangement as seen in FIG. 3 illustrates a prior art direct or "dry" expansion evaporator 150 which is automatically fed with liquid refrigerant by a thermostatically controlled expansion valve 160. It should be understood that the expanded refrigerant leaving the thermostatically controlled expansion valve 160 is equally distributed to multiple parallel circuits herein indicated by the numerals 151 by the refrigerant distributor 170. The thermostatically controlled expansion valve 160 continuously measures either mechanically, or electronically, the amount of superheat in the refrigerant vapor leaving the evaporator at the point indicated by 190 by means of a temperature sensor 155, and pressure sensor which is generally indicated by the numeral 210. As should be understood, the word "superheat" for the purposes of this application means a sensible heat in a gas above the amount needed to maintain the gas phase thereof. As the thermostatically controlled expansion valve 160 senses increasing superheat, it opens thereby allowing more liquid ammonia refrigerant (not shown) to enter the evaporator 150. On the other hand, as the thermostatically controlled expansion valve 160 senses decreasing superheat, it closes thereby decreasing the amount of refrigerant entering the evaporator 150. As should be understood, the liquid line solenoid valve 172 is normally open during operation. However, when the cooling load in a refrigerated space (not shown) is satisfied, or when a defrost cycle is initiated, the liquid level solenoid valve 172 is closed thereby shutting off the flow of liquid ammonia refrigerant to the evaporator 150. This direct expansion method of controlling the flow of liquid refrigerant to the evaporator 150 is simpler, less costly and minimizes the amount of liquid or refrigerant in the system as compared to the prior art gravity flooded and liquid overfeed systems as shown in FIGS. 1 and 2, respectively.

Referring now to FIG. 4, a multiplicity of two-phase flow patterns during evaporation of the liquid ammonia refrigerant in smooth inside diameter horizontally disposed evaporator tubes 12, is shown. When viewing FIG. 4, it should be understood that the flow of liquid ammonia refrigerant is from the left side of the drawing to the right side of the drawing. The flow includes a single phase liquid region 270; bubble flow region 260; plug flow region 250; wavy flow region 240; annular flow region 230; and dry wall flow region 220. Not every region may be present at any one time depending on the design. As seen in this drawing, and with smooth, inside diameter evaporator tubes 12, the highly desirable annular flow pattern is generally indicated by the numerals 220 and 230 respectively and which are seen in FIGS. 4D and 4E, respectively. The flow pattern is created by vapor shear forces. Still further, the highly undesirable stratified-wavy flow patterns, as seen in FIG. 4C, and which is indicated by the numeral 240, unavoidably appear with low temperature direct expansion ammonia evaporator designs of the prior art. In this regard, a direct expansion ammonia refrigeration system operating at low temperatures operates predominately in this stratified, wavy flow region. The stratified-wavy flow patterns 240 as seen in FIG. 4C, appears to severely restrict the performance and the effective use of prior art direct expansion ammonia refrigeration systems as described earlier. The stratified-wavy flow pattern 240 appears to effect the boiling heat transfer coefficients of the liquid ammonia refrigerant and therefore evaporator performance is severely inhibited by stratified-wavy flow patterns 240.

Referring now to FIG. 5, various wicking structures which constitute a feature of the present invention are shown. As illustrated, one aspect of the present invention relates to a plurality of evaporator tubes 200 which are incorporated within an evaporator structure that is generally indicated by the numeral 390 in FIG. 10 and following. The plurality of evaporator tubes have an outside facing surface 201, and an opposite inside facing surface 202, respectively. The inside facing surface defines a cavity 203 which allows a source of liquid ammonia refrigerant to pass therethrough. Referring now to FIGS. 5A and 5A1, in a first form of the present invention which includes various wicking structures, an evaporator tube 200 is provided and which is coupled in fluid receiving relation relative to a source of liquid ammonia refrigerant (not shown), and which has an inside facing surface 202 having a wicking structure generally indicated by the numeral 206. In this arrangement, by capillary action facilitated by the wicking structure 206, the liquid ammonia refrigerant is drawn up onto and along the inside facing surface 201 of the evaporator 200 so as to substantially mitigate the negative effect of any stratified and/or wavy flow patterns 240 of the liquid ammonia refrigerant within the evaporator tube 200. The wicking structure 206, as seen in this form of the invention, comprises a multiplicity of helical grooves having a depth of about 0.005 to about 0.05 inches, a spacing of about 0.01 to about 0.10 inches; and a lead angle of about 15 degrees to about 90 degrees, respectively. Referring now to FIG. 5A2, a second form of the wicking structure 207 is shown. The evaporator tube 200 in this form includes a wicking structure 205 which is formed into the inside facing surface 201, and which comprises a multiplicity of cross-hatched knurls 207 which are formed into the inside facing surface of the evaporator tube 200, and which are dimensioned so as to generate the desired capillary action. In the arrangement as seen in FIG. 5A2, the respective cross-hatched knurls 207 have a length of about 0.005 to about 0.05 inches; a spacing of about 0.01 to about 0.10 inches; and a lead angle of about 15 degrees to about 90 degrees, respectively.

Referring now to FIGS. 5B, 5B1 and 5B2, a third form of the wicking structure 205 comprising a feature of the present invention is shown. In this form of the invention, the direct expansion ammonia refrigeration system has a plurality of evaporator tubes 200 which have a wicking structure 208 which comprises a sintered metal coating which is deposited upon the inside facing surface 202 of the evaporator tube 200. This sintered metal coating 208 is effective in drawing the liquid ammonia refrigerant, by capillary action, up onto the inside facing surface 202 of the evaporator tube 200. In the arrangement as seen in FIGS. 5B, 5B1 and 5B2, the sintered metal coating is formed from a metal selected form the group comprising stainless steel; nickel; copper; and/or aluminum. Still further, in this arrangement (FIG. 5B2), the sintered metal coating 208 is formed to have a plurality of pores 204 having a pore radius of about 0.001 to about 0.04 centimeters. In yet another form of the wicking structure 205 of the present invention and as seen by reference to FIGS. 5C and 5C1, the wicking structure 205 comprises a wire mesh which is generally indicated by the numeral 209, and which has a mesh size ranging from about 60 to about 450 openings per inch. Again, the wire mesh 280 is formed from a metal selected form the group comprising stainless steel; nickel; copper; and/or aluminum. All forms of the invention as seen in FIG. 5 produce effective capillary action so as to facilitate the advantageous operation of the present invention.

FIG. 6 illustrates, in a graph, the effects of water on the boiling point of a source of liquid ammonia refrigerant 290 when measured at 10.398 psia and a temperature of −40 degrees F. As will be seen from reviewing that graphical depiction, as the concentration of water and liquid ammonia refrigerant increases, so does the boiling or "bubble" point of the ammonia-water solution. Whenever water is present in the liquid ammonia refrigerant, even in small amounts, the boiling point increases and performance of any direct expansion evaporator will be substantially impeded. In addition, in any prior art arrangement such as seen in FIGS. 1-3, the thermostatically controlled expansion valve utilized with same will typically allow aqueous ammonia to exit the evaporator due to its failure to detect the correct superheat of the refrigerant vapor exiting same. As earlier discussed, and as seen in FIGS. 6-9, the introduction of even a small amount of water to a direct expansion ammonia refrigeration system is quite disadvantageous because such aqueous ammonia will usually damage any compressor utilized with the refrigeration system.

Referring now to FIG. 7, this drawing illustrates the relationship between the increase in boiling or "bubble" point 300 of a liquid ammonia refrigerant as it enters an evaporator circuit at a location which is positioned at the left of the X axis 310 and evaporates over the length of the evaporator circuit moving in a direction from left to right 320 where it exits the evaporator at a point 330 as seen on the graph. Again, this shows the impact of a small amount of water in a refrigeration system.

FIG. 8 graphically depicts the corresponding increase in the concentration of water in the liquid ammonia refrigerant 340 as the liquid ammonia refrigerant enters the evaporator circuit at the left 350 of the X axis and evaporates over the length of the evaporator circuit moving from the left 350 to the right 360 to exit the evaporator at a point indicated by the numeral 370.

Figure 9:
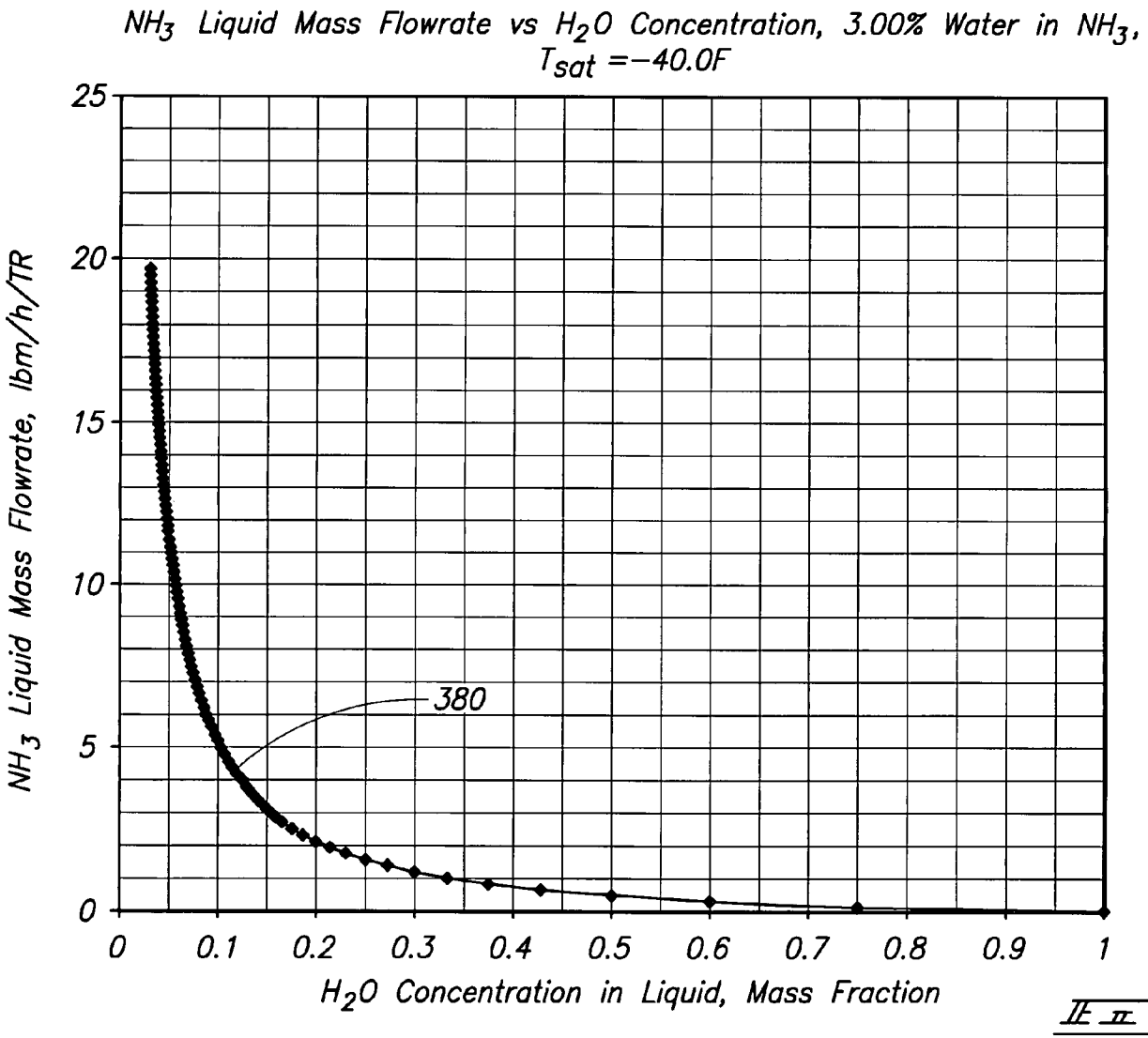
FIG. 9 is a graphical depiction showing ammonia liquid mass flow rate versus water concentration. This is calculated at a 3% water concentration with ammonia with an initial temperature of saturation at −40 degrees F.
Figure 11:
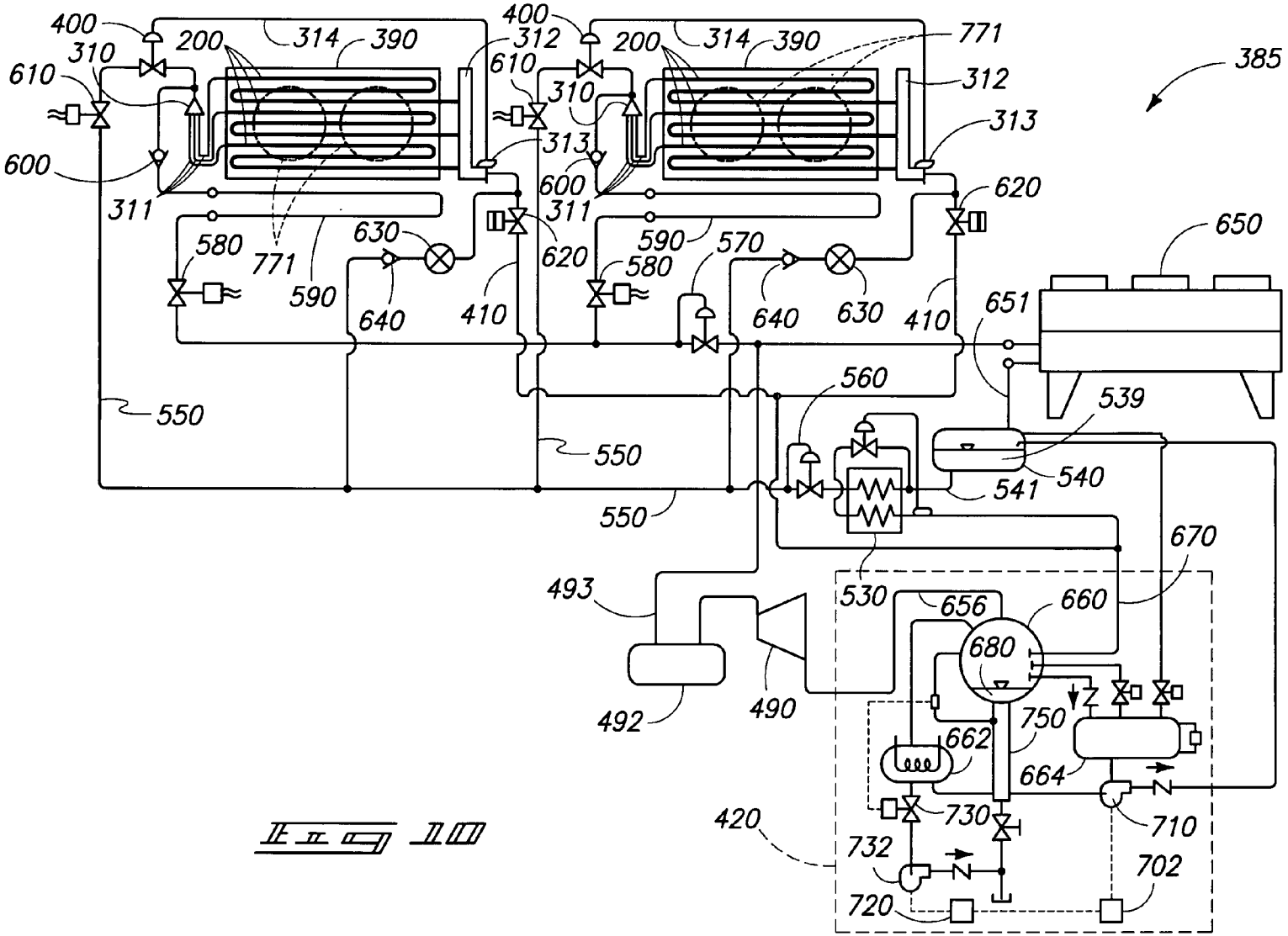
Figure 11:
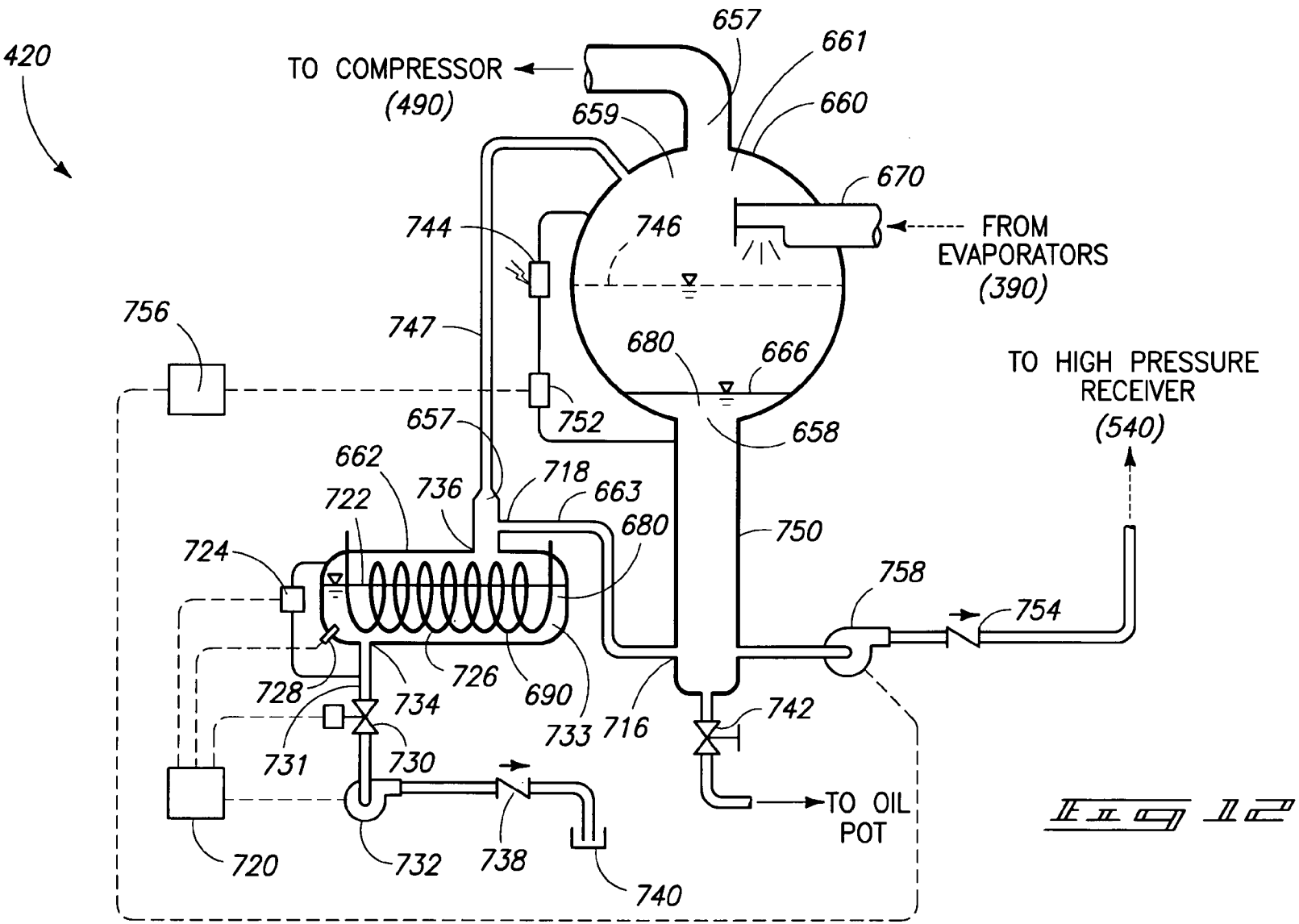
Figure 11:
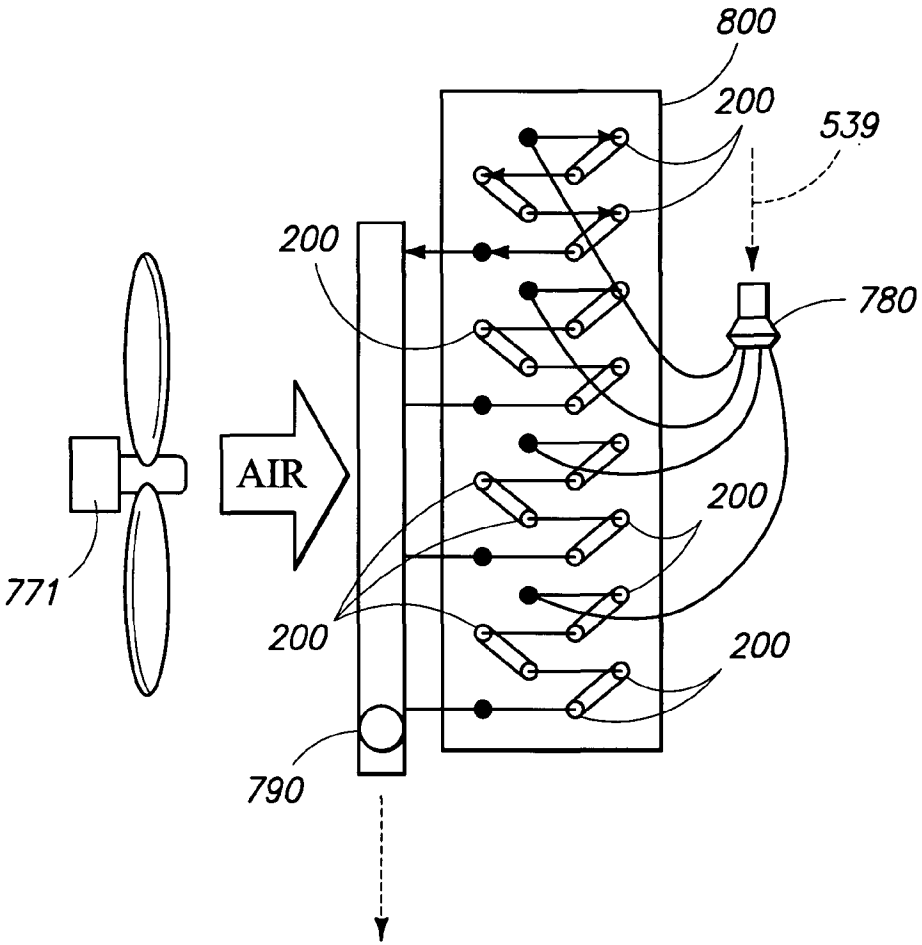

FIG. 9 illustrates in a graphical depiction the mass flow rate of a liquid refrigerant mixture comprising ammonia and water 380 leaving the output of an evaporator versus the concentration of water in the liquid mixture leaving the evaporator. Again, it is seen that even a small amount of water will seriously impair the performance of a refrigeration system.

Referring now to FIG. 10 and following, one form of practicing the present invention is seen. In this regard, the direct expansion ammonia refrigeration system 385 includes a plurality of evaporators 390 each incorporating at least some of the evaporator tubes 200 which were described earlier and seen in FIG. 5. The evaporators 390 are each coupled in fluid flowing relation relative to a distributor 310. The distributor 310 further mounts a plurality of fluid leads which are generally indicated by the numeral 311, and which delivers a source of liquid ammonia refrigerant 539 to the respective evaporators 390. Still further, and as described earlier, the respective evaporators 390 include an exhaust manifold 312. It should be understood that the plurality of evaporator tubes 200 are coupled in fluid flowing relation relative thereto. Still further, and mounted near the exhaust manifold 312 is a temperature sensor 313 which is coupled by electrical leads 314 to a thermostatic expansion valve 400 which is positioned upstream relative to the distributor 310. As a general matter, the direct expansion evaporators 390, as seen in FIG. 10, receive liquid ammonia refrigerant by means of the thermostatic expansion valves 400. Further, the liquid ammonia refrigerant boiled in the evaporators 390 is returned through the suction return line or conduit 410 to a combined suction accumulator vessel and concentrator heat exchanger which is generally indicated by the structure which is contained within the box labeled 420, and which is described and shown in one form in FIG. 11. In the arrangement as found in FIG. 10 and following, it should be appreciated that high pressure and temperature refrigerant gas from the discharge of the compressor 490 first flows to a high efficiency oil separator which generally indicated by the numeral 492, and which is well known in the art. In the arrangement as seen in FIG. 10 and following, it is important to understand that oil must be removed from the source of the liquid ammonia refrigerant by the high efficiency oil separator 492 so as to prevent any oil from reaching the respective evaporators 390. If oil was to reach these evaporators, the oil would have the effect of quickly fouling the wicking structures 205 as seen in FIG. 5, and which are located on the inside facing surfaces 202 of the respective evaporator tubes 200. The fouling of the wicking structures 205 in the evaporator tubes 200 would have the effect of reducing the capillary action needed to draw the source of a liquid ammonia refrigerant 539 up onto the evaporator tube walls. This would, in turn, reduce the evaporator 390 performance by allowing the stratified wavy flow pattern of the refrigerant within the respective evaporator tubes 200.

The source of gaseous ammonia refrigerant 539 flows from the oil separator 492 by way of the conduit 493 to the condenser 650 where it is condensed to liquid form 539 and passes by way of conduit 651 into a high pressure receiver or vessel 540. Positioned downstream in fluid flowing relation relative to the high pressure receiver 540 by means of a conduit 541 is a direct expansion mechanical subcooler which is generally graphically indicated by the numeral 530 in FIG. 10. The direct expansion mechanical subcooler 530, which is well known in the art, is sized as to provide enough subcooling of the source of a liquid ammonia refrigerant 539 leaving the high pressure receiver 540 so as to prevent flashing or rapid evaporation of the liquid refrigerant in the liquid delivery lines 550 due to frictional and static pressure drops. A liquid delivery line pressure regulating valve which is generally indicated by the numeral 560 is located in fluid metering relation along the liquid delivery line 550. This valve is operable to maintain the liquid delivery line pressure lower than the defrost hot gas pressure which is determined by the defrost pressure regulating valve 570. This pressure differential allows the source of a liquid ammonia refrigerant 539 condensed in the evaporators 390 during a defrost to be pushed back into the liquid delivery lines 550 and then used by other non-defrosting evaporators 390.

As should be understood, during a defrost cycle of the refrigeration system 385, the flow of liquid ammonia refrigerant 539 is first shut off to the designated defrosting evaporators 390 by first shutting the liquid level solenoid valve which is generally indicated by the numeral 610. A suction stop valve 620 is provided and remains open to allow liquid refrigerant in the evaporator to completely evaporate or be pumped out. Once this pump out period is completed, the suction stop valves 620 are closed. It is important to note that in large systems with multiple evaporators 390 approximately one-third of the evaporators in the system 385 are defrosted while the remaining two-thirds continue operating normally. In the arrangement as shown in FIG. 10 hot ammonia gas from the discharge of the compressor 490 is then admitted to the defrosting evaporator coil 390 through a hot gas solenoid valve which is generally indicated by the numeral 580. The hot gas first warms an evaporator drain pan loop which is generally indicated by the numeral 590, and which is located in a drain pan (not shown) which is located under the defrosting evaporator core 390. The hot gas then passes through a check valve 600, and on into the evaporator 390 by means of the distributor 311, where it subsequently condenses to liquid form. When the hot ammonia gas condenses to liquid form, this refrigerant warms the evaporator 390 surface in the process and melts accumulated frost and ice. Condensed liquid ammonia refrigerant from the defrosting then passes through a liquid drainer 630 of conventional design, and a check valve 640. The liquid refrigerant is then fed back into the liquid delivery line 550 where it is used by other non-defrosting evaporators 390.

Figure 11:
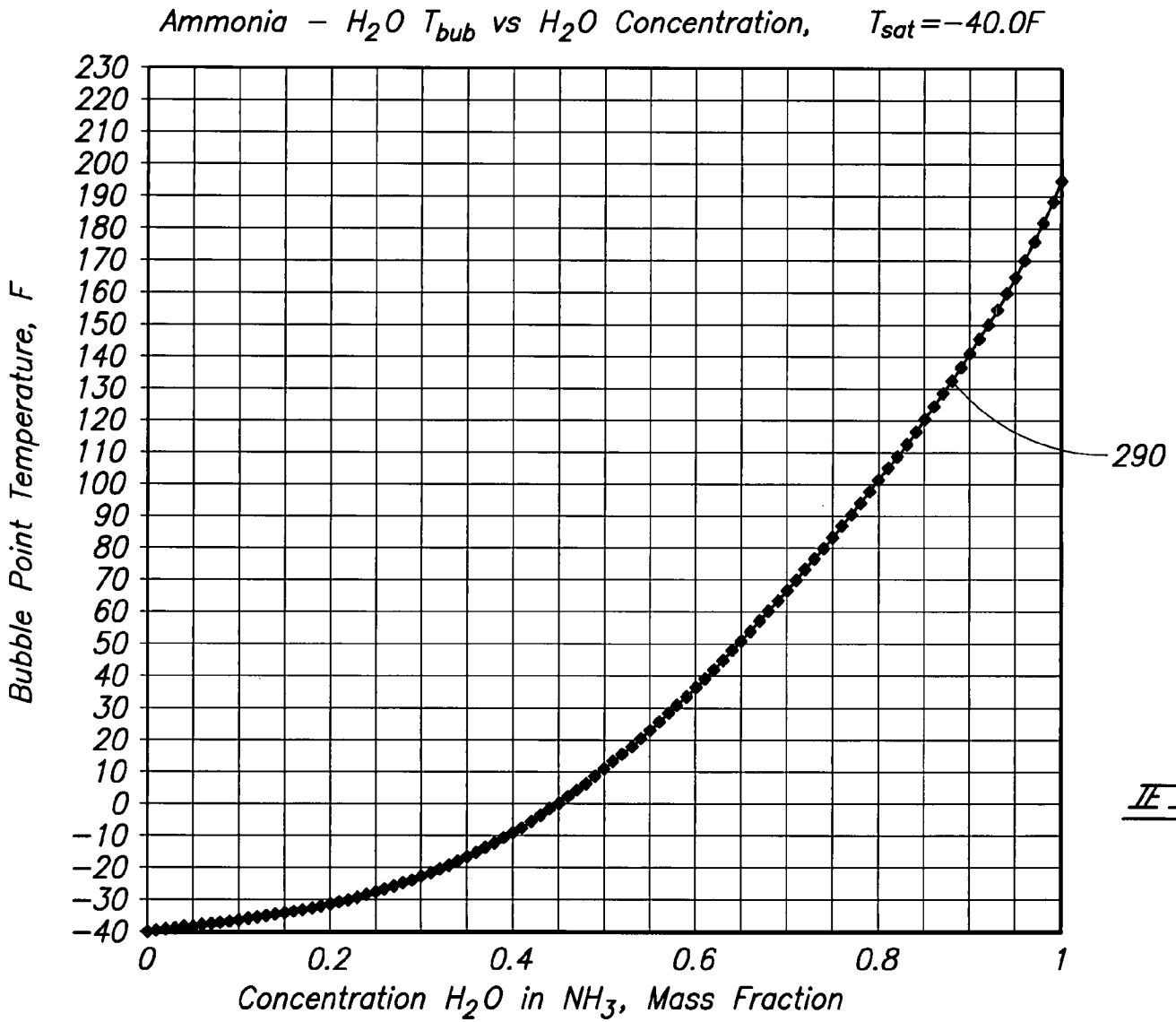
FIG. 11 is a greatly simplified, fragmentary, schematic view of a feature of the present invention.
Figure 11:
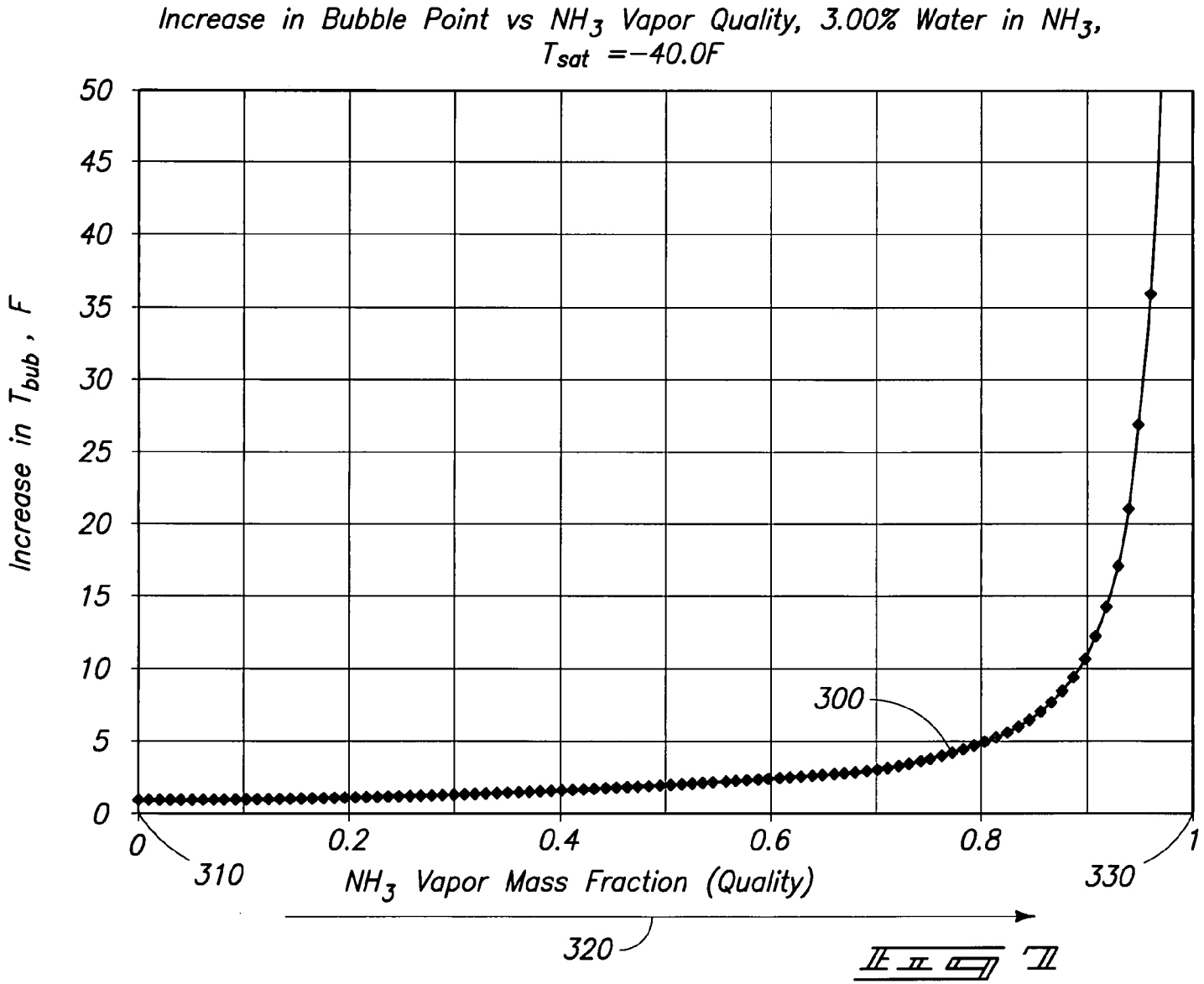
Figure 11:
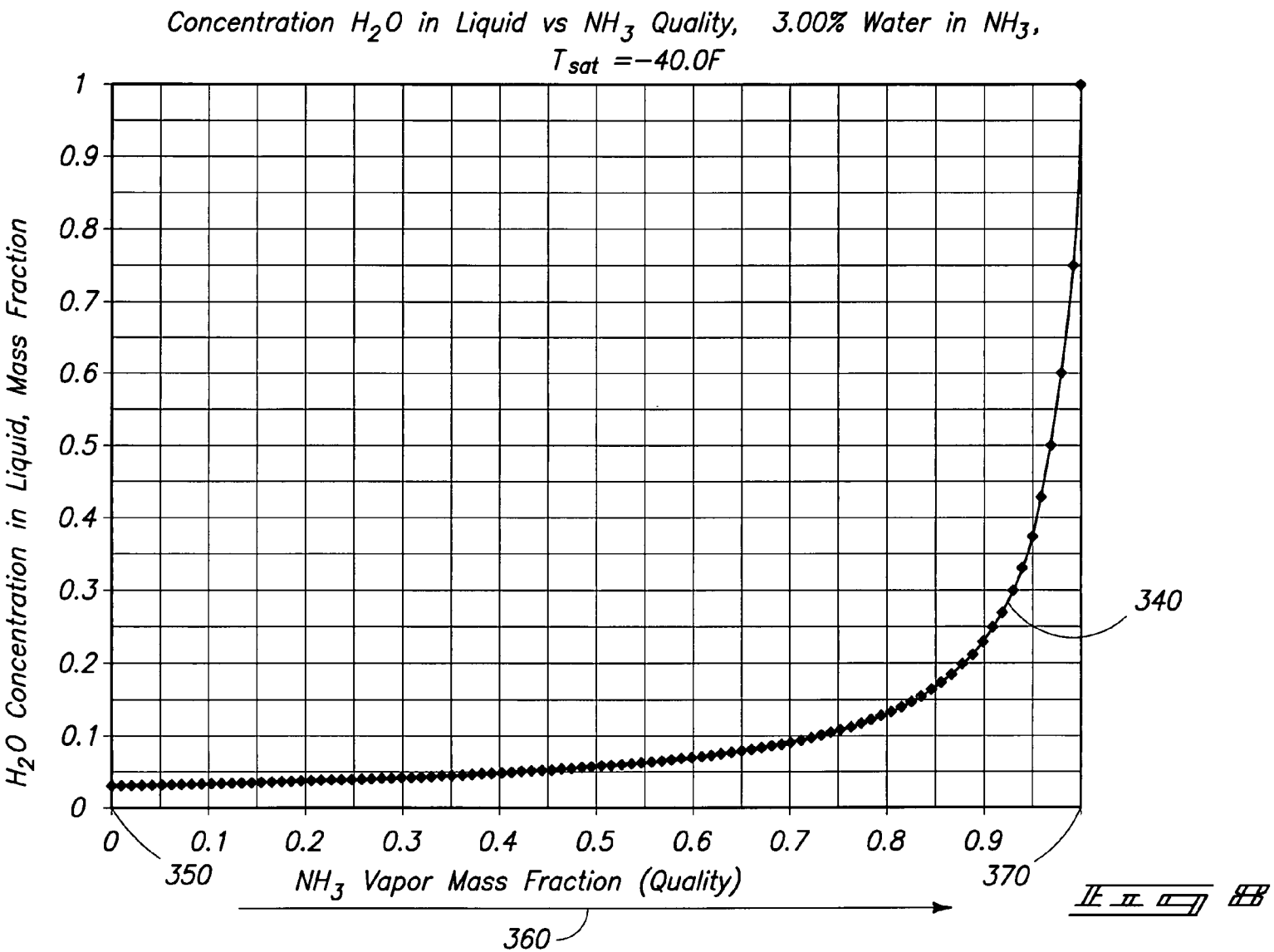

Referring now to FIG. 11, one form of a combined accumulator vessel and concentrator heat exchanger vessel 420 (FIG. 10) is shown in a greatly enhance view. The structure 420 includes a low pressure accumulator vessel 660; concentrator heat exchanger vessel 662; and liquid transfer vessel 664. These vessels are each fluidly coupled together and designed to work together to manage and therefore eliminate any ammonia-water liquid which leaves the respective evaporators 390. As earlier discussed, liquid ammonia refrigerant has a strong affinity for water and consequently the management of any ammonia-water liquid leaving the evaporators 390 is important inasmuch as this same solution may, if left unchecked, have the effect of damaging the compressor 490 should it be received in same, as well as reduce the overall performance of the refrigeration system 385. In this regard, the source of liquid ammonia refrigerant 539 which is boiled in the respective evaporators 390 is returned through the suction return line 670 to a special low-pressure accumulator vessel which is generally indicated by the numeral 660. Any ammonia-water liquid mixture (hereinafter referred to as aqueous ammonia refrigerant) 680 leaving the evaporators 390 is captured by the accumulator vessel 660 and is prevented from reaching the compressor 490. It is important to understand that only substantially dry ammonia vapor 657 returns to the compressor 490 from the top portion or vapor region 661 of the accumulator vessel 660 where it is safely recompressed. The substantially dry ammonia vapor 657 is delivered to the compressor by means of conduit 656.

The liquid transfer vessel 664 which is coupled in fluid flowing relation relative to the low pressure accumulator vessel 660 acts in a fashion so as to maintain a safe liquid refrigerant level in the low pressure accumulator vessel 660. In this regard, any accumulating aqueous ammonia refrigerant 680 which reaches the level of the inlet connection indicated by the numeral 690 drains by gravity through a low spring pressure check valve which is generally indicated by the numeral 700 and into the liquid transfer vessel 664. A multifunction controller 702 is provided, and is electrically coupled with the various assemblies described, and which further controls a low pressure solenoid vent valve 704; a high pressure solenoid vent valve 706; a liquid level switch 708; and a low head pressure liquid transfer pump 710. During the filling cycle, the multifunction controller 702 keeps the low pressure solenoid vent valve 704 open and fluidly coupled to the vapor region 661 of the low pressure accumulator vessel 660. Still further, the high pressure solenoid vent valve 706 is closed to the top of the high pressure receiver tank 540; and the low head pressure liquid transfer pump 710 is de-energized. When the liquid ammonia level 712 of the liquid transfer vessel 664 reaches the level of the liquid level switch 708, the multifunction controller 702 is operable to close the low pressure vent solenoid valve 704; open the high pressure vent solenoid valve 706; and energize the low head pressure liquid transfer pump 710. By this action, the low head pressure liquid transfer pump 710 pumps the liquid aqueous ammonia refrigerant in the liquid transfer vessel 664 through a check valve 714 to the high pressure receiver 540 by means of a conduit 715. This aqueous ammonia refrigerant is then mixed with condensed ammonia refrigerant 748 received from the condenser 650. The multifunction controller 702 keeps the low head liquid transfer pump 710 energized for a predetermined period of time which is sufficient so as to substantially empty the liquid transfer vessel 664 of its liquid mixture. After this predetermined time period expires, the multifunction controller 702 de-energizes the low head liquid transfer pump 710; closes the high pressure vent solenoid valve 706; and opens the low pressure vent solenoid valve 704 to resume the filling cycle.

Referring still to FIG. 11, it should be understood that the aqueous ammonia refrigerant 680 enters the concentrator heat exchanger vessel designated 662 by gravity and by means of an inlet connecting pipe or first conduit which is generally indicated by the numeral 663. In the arrangement as seen, it is important to note that the inlet connecting pipe has a pipe entrance or first end 716 which is at an elevation lower than the concentrator heat exchanger vessel 662. Still further, the pipe outlet or second end 718 is at an elevation higher than the concentrator heat exchanger vessel 662. This arrangement of the inlet connecting pipe 663 prevents an aqueous ammonia refrigerant mixture 680 from flowing back into the low pressure suction accumulator vessel 660 as it is heated by the concentrator heat exchanger vessel 662. Aqueous ammonia refrigerant enters into the concentrator heat exchanger vessel 662 where it is warmed and distilled by a heating element 690. With increasing temperature, the aqueous ammonia refrigerant is increasingly vaporized in the concentrator heat exchanger vessel 662 to produce substantially dry ammonia gas 657. This gas 657 returns by means of the conduit 747 to the top vapor region 661 of the low pressure accumulator vessel 660. Again, a multifunction controller 720 senses the liquid level 722 in the concentrator heat exchanger vessel 662 by means of a liquid level sensor 724, and the temperature of the liquid mixture 726 by way of a temperature sensor 728. Still further, the controller 720 controls a drain solenoid valve which is generally indicated by the numeral 730, and which is positioned downstream of the concentrator heat exchanger vessel 662. The temperature sensor as provided at 728, and the drain opening 734 are located at the end of the concentrator heat exchanger vessel 662 which is opposite to the inlet opening which is generally indicated by the numeral 736. When the multifunction controller 720 senses that an acceptably concentrated aqueous ammonia byproduct solution 733 is present to the level of the liquid level switch 724 and the temperature of the solution 730 is at or above 95 degrees F., the controller then opens the normally closed drain solenoid valve 730 and energizes the liquid purge pump 732 for a predetermined period of time. The multifunction controller 720 keeps the drain solenoid valve 730 and liquid purge pump 732 energized long enough to empty the concentrator heat exchanger vessel 662 of its acceptably concentrated aqueous ammonia byproduct solution 733. For purposes of this application, an acceptably concentrated aqueous ammonia byproduct solution has an ammonia concentration of less than about 20% by weight, or otherwise is in a concentration which provides no significant environmental impact if the aqueous ammonia solution is discharged to the immediate environment. After this predetermined period of time expires, the multifunction controller 720 deenergizes the liquid purge pump 732 and closes the drain solenoid valve 730 to resume filling the concentrator heat exchanger vessel 662 with aqueous ammonia refrigerant.

As seen in FIG. 11, a high liquid level alarm switch 744 is operably coupled with the low pressure suction accumulator vessel 660. This switch is operable, in combination with the controller 720, to shut down the refrigeration system 385 in the event that the safe maximum liquid level 746 is exceeded. In addition to the foregoing, and as seen in FIG. 11, an oil drain valve 742 is coupled in fluid flowing downstream relation relative to the liquid leg 750 of the low pressure suction accumulator vessel 660. The oil drain valve 742 allows excess oil to be removed from the system periodically by means of an oil pot of conventional design (not shown).

Figure 12:
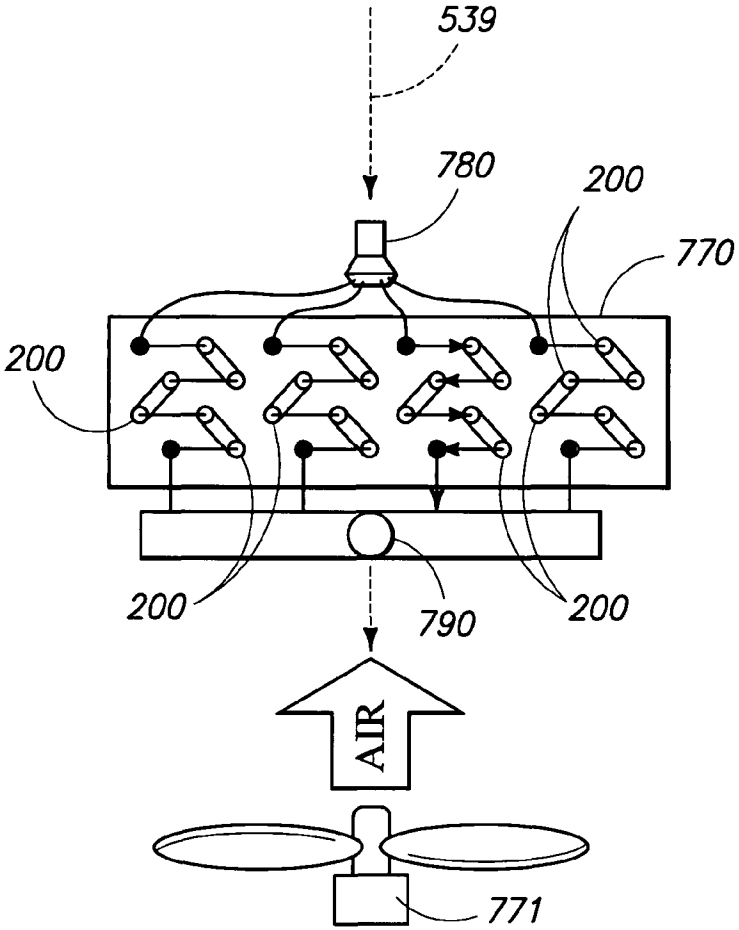
FIG. 12 is a second form of the inventive feature as seen in FIG. 11.

Referring now to FIG. 12, this view illustrates an alternative version of one feature of the present invention. In this regard, a special low pressure accumulator vessel which is generally indicated by the numeral 660; concentrator heat exchanger vessel generally indicated by the numeral 662; and high head pressure liquid transfer pump 758 are coupled in fluid flowing relation together, and are arranged so as to manage the aqueous ammonia refrigerant 680 leaving the respective evaporators 390. The refrigerant which has boiled in the evaporators 390 is returned through the suction return line 660 to the special suction accumulator vessel 660 as seen in FIG. 12. Any aqueous ammonia refrigerant 680 leaving the evaporators 390 is captured by the accumulator vessel 660, and prevented from reaching the compressor 490. In the arrangement as seen in this drawing, only substantially dry ammonia vapor 657 returns to the compressor 490 from the top or vapor region 661 of the accumulator vessel 660 where it is safely recompressed. In the arrangement as seen in FIG. 12, the high head liquid transfer pump 758 acts to transfer the liquid aqueous ammonia refrigerant 680 which is received from the respective evaporators 390 to the high pressure receiver 540. A multifunction controller 756 is provided and which energizes the high head liquid transfer pump 758 whenever the aqueous ammonia refrigerant is above the low liquid level switch 752 as seen in that drawing. When it is energized, the high head liquid transfer pump 758 pumps aqueous ammonia refrigerant from the bottom of the liquid leg 750 through a check valve 754 to the high pressure receiver 540. Again, as in FIG. 11, aqueous ammonia refrigerant 680 enters the concentrator heat exchanger vessel 662 by gravity through an inlet connecting pipe 663 where it is warmed and distilled by the heating element 690. The heat energy causes the liquid ammonia refrigerant to vaporize into substantially dry ammonia vapor or gas 657. Any vaporizing refrigerant in the concentrator heat exchanger vessel 662 returns to the top or vapor regions 661 of the low pressure accumulator vessel 660 through a conduit generally indicated by the numeral 747. The heating element 690, as seen in FIGS. 11 and 12, are temperature self-regulating so that the temperature of the element cannot exceed 125 degrees F. The heating element 690 may be an electric resistance heater or heat exchanger utilizing a heated fluid such as glycol or a warm refrigerant liquid. In this regard, it is important to understand that the conduit entrance 716 to the inlet connecting pipe 663 is at an elevation lower than the concentrator heat exchanger vessel 662. Still further, it is important to note that the pipe outlet 718 is at an elevation higher than the concentrator heat exchanger vessel 662. This arrangement of the inlet connecting conduit 663 prevents the water-ammonia liquid or solution 680 from flowing back into the low pressure accumulator vessel 660 as it is heated and its density increases due to the increasing concentration of water in the mixture. Again, a multifunction controller 720 senses the liquid level 722 in the concentrator heat exchanger vessel 662 by way of a liquid level sensor 724. The temperature of the liquid mixture 726 is taken by way of a temperature sensor 728. The temperature sensor and the liquid level sensor controls a drain solenoid valve 730 and a liquid purge pump 732. The temperature sensor 728 and the drain opening 734 are located at the end of the concentrator heat exchanger vessel 662 which is opposite the inlet opening 736. When the multifunction controller 720 senses that acceptably concentrated aqueous ammonia byproduct 783 is present to the level of the liquid level switch 724, and the temperature of the same acceptably concentrated aqueous ammonia byproduct is at or above 95 degrees F. it opens the normally closed drain solenoid valve 730 and energizes the liquid purge pump 732 for a preset period of time. The multifunction controller 720 keeps the drain solenoid valve 730 and the liquid purge pump energized long enough to empty the concentrator heat exchanger vessel 662 of its byproduct solution 233. During this draining cycle, the liquid purge pump 732 pumps the byproduct mixture 733 through a check valve 738 to a drain 740. After the preset period of time expires, the multifunction controller 720 deenergizes the liquid purge pump, closes the drain solenoid valve 730 to resume filling the concentrator heat exchanger vessel 662 with aqueous ammonia refrigerant 680. Again, this draining does not take place unless the ammonia byproduct 733 concentration is less than about 20% by weight of ammonia. In the arrangement as seen in the drawings, a high liquid level alarm switch 744 senses the liquid level in the low pressure accumulator vessel 660 and shuts down the refrigeration system 385 in the event that the safe maximum liquid level 746 is exceeded. An oil drain valve 742 is installed at the bottom of the cumulative liquid leg 750 to allow excess oil to be removed from the system periodically by way of an oil pot of conventional design (not shown).

FIGS. 13 and 14 illustrate properly designed direct expansion ammonia evaporator 390 fluid circulating arrangements. For evaporators 390 which are oriented for operation with vertical air flow 770, liquid ammonia refrigerant 539 enters through the refrigerant distributor 780 at the highest point in the evaporator 770. The refrigerant passes through multiple parallel fluid flowing circulating circuits such that each circuit is freely draining by gravity to the next adjoining level, that is, each successive pass in the refrigeration circuit is at the same or lower elevation. Refrigerant vapor exits the evaporator 770 at the lowest point indicated by the numeral 790. Again, an air movement assembly here, generally indicated by the numeral 771 is provided and which, when energized, produces air movement through the evaporator 771. For evaporators 800 which are oriented for horizontal air flow, the liquid refrigerant 539 enters through the refrigerant distributor 780 and again is provided at the highest point of the evaporator 800. Similar to the vertical air flow evaporator, the refrigerant passes through the multiple parallel fluid flowing circuits such that each circuit is freely gravitationally drained, that is, each successive pass in the circuit is at the same or lower elevation. Refrigerant vapor exits the evaporator at the lowest point which is indicated by the numeral 790.

Having described, more broadly the present invention, the specific inventive features of the present invention are now set forth. In its broadest aspect, the present invention relates to a direct expansion ammonia refrigeration system generally indicated by the numeral 385 in FIG. 10. As seen therein, the direct expansion ammonia refrigeration system 385 includes a source of liquid ammonia refrigerant which is generally indicated by the numeral 539; and at least one evaporator tube 200 coupled in fluid receiving relation relative to the source of liquid ammonia refrigerant 539, and which has an inside facing surface 202 (FIG. 5) having a wicking structure 205. By capillary action, facilitated by the wicking structure 205, the wicking structure is operable to effectively draw the liquid ammonia refrigerant 539 along the inside facing surface 202 of the evaporator tube 200 so as to substantially reduce any stratified and/or wavy flow patterns 240 of the liquid ammonia refrigerant 539 within the evaporator tube 200. As seen in FIG. 5 and following, the wicking structure 205 may take on different forms including a multiplicity of helical grooves 206 which are formed into the inside facing surface 202 of the evaporator tube 200, and which are dimensioned so as to generate the desired capillary action. In this regard, the helical grooves have a depth of about 0.005 to about 0.05 inches, a spacing of about 0.01 to about 0.10 inches; and a lead angle of about 15 degrees to about 90 degrees. In one possible form of the wicking structure 205, as seen in FIG. 5, the wicking structure comprises a multiplicity of cross-hatched knurls 207 formed into the inside facing surface 202 of the evaporator tube 200, and which are dimensioned so as to generate the desired capillary action. In this regard, the cross-hatched knurls have a length of about 0.005 to about 0.05 inches; a spacing of about 0.01 to about 0.10 inches; and lead angle of about 15 degrees to about 90 degrees. In another possible form of the invention as seen in FIG. 5, the wicking structure 205 comprises a sintered metal coating 208 deposited upon the inside facing surface 202 of the evaporator tube 200, and which is effective in drawing the liquid ammonia refrigerant 539 by the effect of capillary action up onto the inside facing surface 202 of the evaporator tube 200. With respect to the sintered metal coating 208, this particular metal coating is formed from a metal selected from the group comprising stainless steel; nickel; copper; and/or aluminum. Further, the sintered metal coating 208 is formed to be porous and have a pore radius 204 of about 0.001 to about 0.04 centimeters. In yet another form of the wicking structure 205 as seen in FIG. 5, the wicking structure comprises a wire mesh 209 which is telescopingly received within and substantially juxtaposed against the inside facing surface 202 of the evaporator tube 200. The wire mesh 209 is formed from a metal selected form the group comprising stainless steel; nickel; copper; and/or aluminum. Still further, the wire mesh has a mesh size 210 ranging from about 60 to about 450 openings per square inch.

Another aspect or feature of the present invention relates to a direct expansion ammonia refrigeration system 385 which includes a source of liquid ammonia refrigerant 539; and a direct expansion ammonia evaporator 390 as seen in FIG. 10. A compressor 490 is provided, and which is coupled in fluid flowing relation relative to the source of liquid ammonia refrigerant 539, and which provides the liquid ammonia refrigerant to the direct expansion ammonia evaporator 390. Still further, an accumulator vessel 660 is provided, and which defines an internal cavity 659 having a liquid region 658, and a vapor region 661. The vapor region 661 is coupled in fluid receiving relation relative to the direct expansion ammonia evaporator 390, and in fluid delivering relation relative to the compressor 490. The liquid region 658 contains aqueous liquid ammonia 680 which is produced by, and received from, the respective evaporators 390. Still further, a heat exchanger vessel 662 is provided, and which is coupled in fluid receiving relation relative to the liquid region 658 of the accumulator vessel 660, and is further in fluid delivering relation relative to the vapor region 661 of the accumulator vessel 660. The heat exchanger vessel 662 includes a heating element 690 which vaporizes the aqueous liquid ammonia 680 so as to deliver substantially dry ammonia vapor 657 to the vapor region 661 of the accumulator vessel 660. The substantially dry ammonia vapor 657 is subsequently delivered to the compressor 490. In addition to the foregoing, the heat exchanger vessel 662 further comprises a drain conduit 731 which removes any acceptably concentrated aqueous ammonia byproduct solution 733 remaining in the heat exchanger vessel 662 after the heating element 690 vaporizes a preponderance of the ammonia from the aqueous liquid ammonia solution 680. For purposes of this application, an acceptably concentrated aqueous ammonia solution has an ammonia concentration of less than about 20% and can therefore be drained from the system and disposed of readily.

In addition to the foregoing features, the direct expansion ammonia refrigeration system 385 as described includes a drain solenoid valve 730 which is positioned along the drain conduit 731 and positioned in selective fluid metering relation relative to the heat exchanger vessel 662. Still further, a temperature sensor 728 is mounted on the heat exchanger vessel 662, and which senses the temperature of the aqueous liquid ammonia 680 which is contained therein. Additionally, a first liquid level sensor 724 for sensing the amount of the aqueous liquid ammonia 680 within the heat exchanger vessel 662 is provided. Additionally, a controller 720 is coupled with the temperature sensor 728 and the first liquid level sensor 724. The controller 720 controls the level and amount of aqueous liquid ammonia 680 within the heat exchanger vessel 662, and which further is electrically controllably coupled to the drain solenoid valve 730. In the arrangement as seen in FIG. 10, the heating element 690 of the heat exchanger vessel may comprise an electric resistance heater. In an alternative form, the heating element 690 of the heat exchanger vessel 662 may comprise a warm liquid heat exchanger.

In addition to the features noted above, the direct expansion ammonia refrigeration system 385 includes a first liquid conduit 663 which has a first end 716, and a second end 718. The first end 716 is coupled in fluid flowing relation relative to the liquid region 658 of the accumulator vessel 660, and the second end 718 is coupled in fluid flowing relation relative to the heat exchanger vessel 662. The first end 716 is positioned at an elevation below the heat exchanger vessel 662, and the second end 718 is positioned at an elevation above the heat exchanger vessel 662. In the arrangement as seen in the drawings (FIGS. 10 and 11), the liquid region 658 and vapor regions 661 of the accumulator vessel 660 are defined relative to each other by a liquid level. In this regard, the accumulator vessel 660 has a minimum liquid level 666, and a maximum liquid level 746. As earlier described, the direct expansion ammonia refrigeration system 385 comprises a plurality of evaporation tubes 200 coupled with the source of liquid ammonia refrigerant 539. Again, each evaporator tube 200 has an inside facing surface 202, and at least some of the inside facing surfaces 202 have a wicking structure 205, which is operable, by capillary action, to facilitate the drawing of the liquid ammonia refrigerant 539 along the inside facing surface 202 of the evaporator tubes 200 to achieve the benefits of the present invention. As seen in FIGS. 13 and 14, the respective plurality of evaporator tubes 200 are coupled in sequential, fluid flowing relation together. More specifically, the evaporator tubes 200 are individually oriented in sequential gravity feeding relation one relative to the others, and wherein the source of ammonia refrigerant 539 enters the evaporator tubes 200 at the highest point, and exits the evaporation tubes at the lowest point. In addition to the foregoing, the direct expansion ammonia refrigeration system 385 further includes a liquid transfer vessel 664 for regulating the liquid level of the accumulator vessel 660. Additionally, a second fluid conduit 681 is provided and which has a first end 682 which is coupled in fluid flowing relation relative to the accumulator vessel 660, and a second end 683 which is coupled in fluid flowing relation relative to the liquid transfer vessel 664. The first end 682 is positioned above the minimum liquid level 666 of the accumulator vessel 660, and below the maximum liquid level 746 of the accumulator vessel 660.

In addition to the foregoing features, a high pressure receiver vessel 540 is provided and which is coupled in selective, fluid flowing relation relative to the liquid transfer vessel 664 referred to in the paragraph, above. Additionally, a plurality of solenoid valves 704 and 706 are individually positioned in selective fluid metering relation therebetween the accumulator vessel 660 and the liquid transfer vessel 664, and between the liquid transfer vessel 664, and the high pressure receiver vessel 540. Additionally, a controller 702 is provided for controlling the operation of the plurality of solenoid valves 704 and 706 so as to selectively regulate the liquid level 666 and 746 of the accumulator vessel 660. Moreover, and as seen in FIG. 10, a second liquid level sensor 744 is mounted on the accumulator vessel 660, and which provides a signal relative to the accumulator vessel liquid level. The controller 702 receives the signal generated from the second liquid level sensor, and thereafter controllably operates a liquid transfer pump 710 which is coupled in selectively fluid removing relation relative to the liquid region 658 of the accumulator vessel 660. Additionally, the high pressure receiver vessel 540 is coupled in fluid receiving relation relative to the liquid transfer pump 710. The controller 702 operates the liquid transfer pump 710 to selectively transfer aqueous liquid ammonia 680 between the accumulator vessel 660, and the high pressure receiver vessel 540, based, at least in part, upon the signal generated from the second liquid level sensor 744, so as to control the accumulator vessel liquid level 666 and 746.

In the drawings, it will be seen that a direct expansion ammonia refrigeration system 385 is described, and which includes a source of liquid ammonia refrigerant 539; and a direct expansion ammonia evaporator 390 which has a plurality of evaporator tubes 200, and which are coupled in fluid flowing relation relative to the source of liquid ammonia refrigerant 539. Yet further, a compressor 490 provides the source of liquid ammonia refrigerant 539 under pressure to the direct expansion ammonia evaporator 390. Still further, an accumulator vessel 660 defining an internal cavity 659 is provided and which has a liquid region 658; and a vapor region 661, which is coupled in downstream fluid flowing relation relative to the direct expansion ammonia evaporator 390. Still further, this structure 660 is coupled in upstream fluid flowing relation relative to the compressor 490. The liquid region 658 contains aqueous liquid ammonia 680 received from the respective evaporators 390. The liquid ammonia 658 and vapor regions 661, respectively, of the accumulator vessel 660, are defined, one relative to the other, by an aqueous liquid ammonia level. As earlier described, the accumulator vessel 660 has a minimum aqueous liquid ammonia level 666, and a maximum aqueous liquid ammonia level 746. A heat exchanger vessel 662 is provided and coupled in downstream fluid flowing relation relative to the liquid region 658 of the accumulator vessel 660, and is further coupled in upstream fluid flowing relation relative to the vapor region 661 of the accumulator vessel 660. The heat exchanger vessel 662 comprises a heating element 690 which vaporizes at least some of the liquid ammonia in the aqueous ammonia refrigerant 680 so as to deliver substantially dry ammonia vapor 657 to the vapor region 661 of the accumulator vessel 660. Still further, a remaining, acceptably concentrated aqueous ammonia byproduct 733 is produced. The substantially dry ammonia vapor 657 is subsequently delivered to the compressor 490. A first liquid conduit 663 having a first end 716, and a second end 718 is provided, and wherein the first end 716 is coupled in fluid flowing relation relative to the liquid region 658 of the accumulator vessel 660. Still further, the second end 718 is coupled in fluid flowing relation relative to the heat exchanger vessel 662. The first end 716 is positioned at an elevation below the heat exchanger vessel 662, and the second end 718 is positioned at an elevation above the heat exchanger vessel 662. A liquid transfer vessel 664 is provided, and coupled in fluid flowing relation relative to the accumulator vessel 660, and which regulates the aqueous liquid ammonia level 666/746 of the accumulator vessel 660. A second fluid conduit 681 is provided having a first end 682 coupled in fluid flowing relation relative to the accumulator vessel 660; and a second end 683 coupled in fluid flowing relation relative to the liquid transfer vessel 664. The first end 682 is positioned above the minimum aqueous liquid ammonia level 666, and below the maximum aqueous liquid ammonia level 746 of the accumulator vessel 660. Additionally, a high pressure receiver vessel 540 is provided and is coupled in fluid flowing relation relative to the liquid transfer vessel 664. A plurality of solenoid valves 704/706 are positioned in fluid metering relation therebetween the accumulator vessel 660, and the liquid transfer vessel 664, and between the liquid transfer vessel and the high pressure receiver vessel 540. A controller 702 is provided for controlling the operation of the plurality of solenoid valves 704/706 so as to regulate the aqueous liquid ammonia level 666/746 of the accumulator vessel.

In addition to the foregoing structures described above, the heat exchanger vessel 662 further comprises a drain conduit 731 which removes the remaining acceptably concentrated aqueous ammonia byproduct 733 in the heat exchanger vessel 662 after the heating element 690 vaporizes substantially all of the aqueous liquid ammonia. In the arrangement as seen in the drawings, a drain solenoid valve 730 is positioned in selective fluid metering relation therebetween the heat exchanger vessel 662 and the drain conduit 731. Still further, a controller 720 is electrically coupled to the drain solenoid 730, and which further controls the level of aqueous liquid ammonia 680 within the heat exchanger vessel 662, and which further controls the selective operation of the drain solenoid valve 730 based, at least in part, upon the level of aqueous liquid ammonia 722 within the heat exchanger vessel 662 as measured by a first liquid level sensor 24, and which is electrically coupled to the controller 720.

In the arrangement as seen in the drawings, an oil separator 492 is provided and which is coupled in fluid flowing relation therebetween the compressor 490 and the direct expansion ammonia evaporator 390 and which is effective to substantially remove any oil from the liquid ammonia refrigerant 539 before the liquid ammonia refrigerant reaches the evaporator tubes 200. Additionally, it will be seen from the drawings that a thermostatic expansion valve 400 is positioned downstream of the compressor 490, and which monitors the temperature and the pressure of the liquid ammonia refrigerant 539 being delivered to the plurality of evaporator tubes 200. Yet further, a distributor 310 is positioned downstream of the thermostatic expansion valve 400, and upstream relative to the plurality of evaporator tubes 200. The thermostatic expansion valve 400 selectively controls the quantity of liquid ammonia refrigerant 539 entering the distributor 310, based, at least in part, upon the temperature and pressure of the liquid ammonia refrigerant 539. As seen in the drawings, the distributor 310 distributes the liquid ammonia refrigerant among the plurality of evaporator tubes 200.

In the arrangement as seen in the drawings, a second liquid level sensor 744 is mounted in liquid level sensing relation relative to the accumulator vessel 660, and which provides a signal relative to the aqueous liquid ammonia level 666/746. As seen in the drawings, a controller 702 is electrically coupled to the second liquid level sensor, and which receives the signal. Additionally, a liquid transfer pump 710 is controllably coupled to the controller 702, and which is further coupled in selective fluid flowing relation relative to the liquid region 658 of the accumulator vessel 660. Further, a high pressure receiver 540 is provided, and which is coupled in fluid flowing relation relative to the liquid transfer pump 710. The controller 702 selectively controls the liquid transfer pump 710 to transfer aqueous liquid ammonia 680 between the accumulator vessel 660 and the high pressure receiver 540, based, at least in part, upon the signal received from the second liquid level sensor 744, and so as to effectively control the accumulator vessel aqueous liquid ammonia level.

The present invention also includes a method of direct expansion ammonia refrigeration. In this regard, and in its broadest aspect the method includes the steps of providing a source of a substantially non-aqueous liquid ammonia refrigerant 539; providing a liquid ammonia expansion evaporator 390 which has a plurality of evaporator tubes 200 coupled in fluid receiving relation relative to the source of aqueous liquid ammonia refrigerant, and wherein each of the plurality of evaporator tubes 200 has an inside facing surface 202 which has a wicking structure 205; and drawing the non-aqueous liquid ammonia refrigerant up onto the inside facing surfaces 202 of the respective evaporator tubes 200 by capillary action by employing the wicking structure 205. In the invention described above, the method further includes a step of substantially reducing any negative effects relating to boiling heat transfer caused by stratified and/or wavy flow patterns 240 of the liquid ammonia refrigerant 539 within the respective evaporator tubes 200.

Another aspect of the method of the present invention includes the step of providing a source of a substantially non-aqueous liquid ammonia 539; and providing a liquid ammonia expansion evaporator 390 which is coupled in fluid flowing relation relative to the source of substantially non-aqueous liquid ammonia. The method further includes the step of supplying the source of the substantially non-aqueous liquid ammonia 539 to the liquid ammonia expansion evaporator; and providing a compressor 490 coupled in upstream fluid flowing relation relative to the liquid ammonia expansion evaporator 390, and in downstream fluid flowing relation relative to the source of the substantially non-aqueous liquid ammonia 539. This same method has an additional step of providing an accumulator vessel 660 defining an internal cavity 659 with a liquid region 658 and a vapor region 661. The vapor region 661 is coupled in downstream fluid flowing relation relative to the direct expansion ammonia evaporator 390, and is further coupled in upstream fluid flowing relation relative to the compressor 490. Additionally, this same method includes a step of providing a heat exchanger vessel 662 coupled in downstream fluid flowing relation relative to the liquid region 658 of the accumulator vessel 660, and in upstream fluid flowing relation relative to the vapor region 661 of the accumulator vessel 660. The heat exchanger vessel 662 further includes a heating element 690. The method includes another step of collecting any aqueous liquid ammonia 680 and any ammonia vapor from the liquid ammonia expansion evaporators 390 into the accumulator vessel 660, and wherein the ammonia vapor collects in the vapor region 661 of the accumulator vessel, and the aqueous liquid ammonia collects in the liquid region 658 of the accumulator vessel 660. The method as described above includes another step of transferring the aqueous liquid ammonia 680 from the liquid region 658 of the accumulator vessel 660 to the heat exchanger vessel 662. The method also includes another step of heating the aqueous liquid ammonia 680 in the heat exchanger vessel 662 to vaporize at least some of the liquid ammonia, and producing a substantially dry ammonia vapor 657, while leaving an acceptably concentrated aqueous ammonia byproduct 733 in the heat exchanger vessel 662. The method includes another step of returning the substantially dry vaporized ammonia 657 to the vapor region 661 of the accumulator vessel 660. Still further, the method includes another step of delivering the substantially dry vaporized ammonia 657 from the vapor region 661 of the accumulator vessel 660 to the compressor 490.

In the methodology as described above and before the step of collecting any aqueous liquid ammonia 680, the method further comprises the steps of compressing the substantially dry ammonia vapor 657 delivered from the vapor region 661 of the accumulator vessel 660 with the compressor 490 to form, at least in part, the source of the substantially non-aqueous ammonia liquid 539, before the step of supplying the substantially non-aqueous ammonia liquid 539 to the liquid ammonia expansion evaporator 390; and after the step of supplying the substantially non-aqueous ammonia liquid 539 to the liquid ammonia evaporator 390, boiling all or a substantial quantity of the non-aqueous ammonia liquid 539 within the liquid ammonia expansion evaporator 390 to produce aqueous liquid ammonia 680 and any ammonia vapor. In the methodology as described above, the method includes another step of removing any acceptably concentrated aqueous ammonia byproduct 733 remaining in the heat exchanger vessel 662. In the methodology as described above, the method includes another step of providing a drain solenoid valve 730 for metering the removal of any acceptably concentrated aqueous ammonia byproduct 733 from the heat exchanger vessel 662; and providing a controller 720 which is electrically coupled to the drain solenoid valve 730, and which controls the operation of the drain solenoid valve. Still further, the method includes another step of sensing the level 722 of the aqueous liquid ammonia 680 within the heat exchanger vessel 662, and producing a signal to the controller 720; and controlling the level 722 of the aqueous liquid ammonia 680 within the heat exchanger vessel 662 by operating the drain solenoid valve 730 in response to the sensing.

In the methodology as described above, the method includes a further step of providing an oil separator 492 which is fluid flowingly coupled intermediate the compressor 490 and the liquid ammonia expansion evaporator 390; and removing substantially any oil from the source of the non-aqueous liquid ammonia 539 with the oil separator 492 before the non-aqueous liquid ammonia 539 reaches the liquid ammonia expansion evaporator 390.

Therefore, it will be seen that a direct expansion ammonia evaporation system and a method of direct expansion ammonia refrigeration system provides many advantages over the prior art teachings and practices as seen in FIGS. 1-3 and which has been described earlier in this application. The present invention provides a convenient means whereby a direct expansion ammonia refrigeration system can be fabricated, implemented and operated in a manner not possible heretofore while avoiding the many shortcomings attendant with the prior art practices.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A direct expansion ammonia refrigeration system, comprising:

a source of liquid ammonia refrigerant;

a direct expansion ammonia evaporator;

a compressor which is coupled in fluid flowing relation relative to the source of liquid ammonia refrigerant, and which provides the liquid ammonia refrigerant to the direct expansion ammonia evaporator;

an accumulator vessel defining an internal cavity having a liquid region, and a vapor region, and wherein the vapor region is coupled in fluid receiving relation relative to the direct expansion ammonia evaporator, and in fluid delivering relation relative to the compressor, and wherein the liquid region contains aqueous liquid ammonia received from the evaporator; and a heat exchanger vessel coupled in fluid receiving relation relative to the liquid region of the accumulator vessel, and in fluid delivering relation relative to the vapor region of the accumulator vessel, and wherein the heat exchanger vessel includes a heating element which vaporizes the aqueous liquid ammonia so as to deliver substantially dry ammonia vapor to the vapor region of the accumulator vessel, and wherein the substantially dry ammonia vapor is subsequently delivered to the compressor.

2. A direct expansion ammonia refrigeration system as claimed in claim 1, and wherein the heat exchanger vessel further comprises a drain conduit which removes any acceptably concentrated aqueous ammonia byproduct solution remaining in the heat exchanger vessel after the heating element vaporizes the ammonia from the aqueous liquid ammonia.

3. A direct expansion ammonia refrigeration system as claimed in claim 2, and wherein the acceptable concentrated aqueous ammonia solution has an ammonia concentration of less than about 20%.

4. A direct expansion ammonia refrigeration system as claimed in claim 2, and further comprising:

a drain solenoid valve positioned along the drain conduit and in selective fluid metering relation relative to the heat exchanger vessel;

a temperature sensor mounted on the heat exchanger vessel, and which senses the temperature of the aqueous liquid ammonia which is contained therein;

a first liquid level sensor for sensing the amount of the aqueous liquid ammonia within the heat exchanger vessel; and a controller coupled with the temperature sensor and first liquid level sensor, and which controls the level and amount of aqueous liquid ammonia within the heat exchanger vessel, and which is further electrically coupled to the drain solenoid valve.

5. A direct expansion ammonia refrigeration system as claimed in claim 1, and wherein the heating element of the heat exchanger vessel is an electric resistance heater.

6. A direct expansion ammonia refrigeration system as claimed in claim 1, and wherein the heating element of the heat exchanger vessel is a warm liquid heat exchanger.

7. A direct expansion ammonia refrigeration system as claimed in claim 1, and further comprising:

a first liquid conduit with a first end, and a second end, and wherein the first end is coupled in fluid flowing relation relative to the liquid region of the accumulator vessel, and the second end is coupled in fluid flowing relation relative to the heat exchanger vessel, and wherein the first end is positioned at an elevation below the heat exchanger vessel, and the second end is positioned at an elevation above the heat exchanger vessel.

8. A direct expansion ammonia refrigeration system as claimed in claim 1, and wherein the liquid and vapor regions of the accumulator vessel are defined relative to each other by a liquid level, and wherein the accumulator vessel has a minimum liquid level and a maximum liquid level.

9. A direct expansion ammonia refrigeration system as claimed in claim 1, and wherein the direct expansion ammonia evaporator comprises a plurality of evaporation tubes coupled with the source of liquid ammonia refrigerant, and wherein each evaporator tube has an inside facing surface, and wherein at least some of the inside surfaces have a wicking structure, and wherein by capillary action, the wicking structure facilitates the drawing of the liquid ammonia refrigerant along the inside facing surface of the evaporator tubes.

10. A direct expansion ammonia refrigeration system as claimed in claim 9, and wherein the respective plurality of evaporator tubes are coupled in sequential fluid flowing relation together, and wherein the evaporator tubes are individually oriented in sequential gravity feeding relation one relative to the others, and wherein the source of ammonia refrigerant enters the evaporator tubes at the highest point, and exits the evaporation tubes at the lowest point.

11. A direct expansion ammonia refrigeration system as claimed in claim 8, and further comprising:

a liquid transfer vessel for regulating the liquid level of the accumulator vessel; and a second fluid conduit with a first end coupled in fluid flowing relation relative to the accumulator vessel, and a second end coupled in fluid flowing relation relative to the liquid transfer vessel, and wherein the first end is positioned above the minimum liquid level of the accumulator vessel, and below the maximum liquid level of the accumulator vessel.

12. A direct expansion ammonia refrigeration system as claimed in claim 11, and further comprising:

a high pressure receiver vessel which is coupled in selective fluid flowing relation relative to the liquid transfer vessel;

a plurality of solenoid valves individually positioned in fluid metering relation therebetween the accumulator vessel and the liquid transfer vessel, and between the liquid transfer vessel and the high pressure receiver vessel; and a controller for controlling the operation of the plurality of solenoid valves so as to selectively regulate the liquid level of the accumulator vessel.

13. A direct expansion ammonia refrigeration system as claimed in claim 8, and further comprising:

a second liquid level sensor mounted on the accumulator vessel, and which provides a signal relative to the accumulator vessel liquid level;

a controller which receives the signal generated from the second liquid level sensor;

a liquid transfer pump which is controlled by the controller, and which is coupled in selectively fluid removing relation relative to the liquid region of the accumulator vessel; and a high pressure receiver vessel, which is coupled in fluid receiving relation relative to the liquid transfer pump, and wherein the controller operates the liquid transfer pump to selectively transfer aqueous liquid ammonia between the accumulator vessel and the high pressure receiver vessel, based, at least in part, upon the signal generated from the second liquid level sensor, so as to control the accumulator vessel liquid level.

14. A direct expansion ammonia refrigeration system, comprising:

a source of liquid ammonia refrigerant;

a direct expansion ammonia evaporator which has a plurality of evaporator tubes, and which are coupled in fluid flowing relation relative to the source of liquid ammonia refrigerant;

a compressor which provides the source of liquid ammonia refrigerant under pressure to the direct expansion ammonia evaporator;

an accumulator vessel defining an internal cavity which has a liquid region; and a vapor region, which is coupled in downstream fluid flowing relation relative to the direct expansion ammonia evaporator, and which is further coupled in upstream fluid flowing relation relative to the compressor, and wherein the liquid region contains aqueous liquid ammonia received from the evaporator, and wherein the liquid and vapor regions of the accumulator vessel are defined, one relative to the other, by an aqueous liquid ammonia level, and wherein the accumulator vessel has a minimum aqueous liquid ammonia level, and a maximum aqueous liquid ammonia level;

a heat exchanger vessel coupled in downstream fluid flowing relation relative to the liquid region of the accumulator vessel, and which is further coupled in upstream fluid flowing relation relative to the vapor region of the accumulator vessel, and wherein the heat exchanger vessel comprises a heating element which vaporizes at least some of the aqueous liquid ammonia so as to deliver substantially dry ammonia vapor to the vapor region of the accumulator vessel, and a remaining acceptably concentrated aqueous ammonia byproduct, and wherein the substantially dry ammonia vapor is subsequently delivered to the compressor;

a first fluid conduit having a first end, and a second end, and wherein the first end is coupled in fluid flowing relation relative to the liquid region of the accumulator vessel, and the second end is coupled in fluid flowing relation relative to the heat exchanger vessel, and wherein the first end is positioned at an elevation below the heat exchanger vessel, and the second end is positioned at an elevation above the heat exchanger vessel;

a liquid transfer vessel coupled in fluid flowing relation relative to the accumulator vessel, and which regulates the aqueous liquid ammonia level of the accumulator vessel;

a second fluid conduit having a first end coupled in fluid flowing relation relative to the accumulator vessel, and a second end coupled in fluid flowing relation relative to the liquid transfer vessel, and wherein the first end is positioned above the minimum aqueous liquid ammonia level, and below the maximum aqueous liquid ammonia level of the accumulator vessel;

a high pressure receiver vessel which is coupled in fluid flowing relation relative to the liquid transfer vessel;

a plurality of solenoid valves positioned in fluid metering relation therebetween the accumulator vessel, and the liquid transfer vessel, and between the liquid transfer vessel and the high pressure receiver; and a controller for controlling the operation of the plurality of solenoid valves so as to regulate the aqueous liquid ammonia level of the accumulator vessel.

15. A direct expansion ammonia refrigeration system as claimed in claim 14, and wherein the direct expansion ammonia evaporator comprises a plurality of evaporator tubes which are sequentially coupled in gravity feeding fluid flowing relation together, and wherein at least some of the evaporator tubes have an inside facing surface which has a wicking structure which, through capillary action, draws the liquid ammonia refrigerant up onto the inside facing surface so as to reduce any stratified and/or wavy flow patterns of the liquid ammonia refrigerant within the evaporator tubes which have the wicking structure.

16. A direct expansion ammonia refrigeration system as claimed in claim 14, and wherein the heat exchanger vessel further comprises a drain conduit which removes the remaining acceptably concentrated aqueous ammonia byproduct in the heat exchanger vessel after the heating element vaporizes the aqueous liquid ammonia.

17. A direct expansion ammonia refrigeration system as claimed in claim 16, and wherein the acceptably concentrated aqueous ammonia byproduct has an ammonia concentration of less than about 20%.

18. A direct expansion ammonia refrigeration system as claimed in claim 16, and further comprising:

a drain solenoid valve positioned in selective fluid metering relation therebetween the heat exchanger vessel and the drain conduit; and a controller electrically coupled to the drain solenoid, and which further controls the level of aqueous liquid ammonia within the heat exchanger vessel, and which further controls the selective operation of the drain solenoid valve based, at least in part, upon the level of aqueous liquid ammonia within the heat exchanger vessel as measured by a first liquid level sensor, and which is electrically coupled to the controller.

19. A direct expansion ammonia refrigeration system as claimed in claim 18, and wherein the heating element mounted within the heat exchanger vessel is an electric resistance heater.

20. A direct expansion ammonia refrigeration system as claimed in claim 18, and wherein the heating element mounted within the heat exchanger vessel is a warm liquid heat exchanger.

21. A direct expansion ammonia refrigeration system as claimed in claim 14, and wherein the respective evaporator tubes each have an inside facing surface which defines individual refrigerant passageways, and wherein the inside facing surface of at least one of the plurality of evaporator tubes has a wicking structure which, by capillary action, has the effect of drawing liquid ammonia refrigerant along the inside facing surface so as to reduce any stratified and/or wavy flow patterns of the liquid ammonia refrigerant as it moves within the at least one of the plurality of evaporator tubes.

22. A direct expansion ammonia refrigeration system as claimed in claim 21, and wherein the wicking structure comprises a multiplicity of helical grooves formed into the inside facing surface of the at least one evaporator tube, and which are dimensioned so as to facilitate the capillary action.

23. A direct expansion ammonia refrigeration system as claimed in claim 21, and wherein the wicking structure comprises a multiplicity of cross-hatched knurls formed into the inside facing surface of the evaporator tube, and which are dimensioned so as to facilitate the capillary action.

24. A direct expansion ammonia refrigeration system as claimed in clam 21, and wherein the wicking structure comprises a sintered metal coating deposited upon the inside facing surface of the evaporator tube, and which is effective by capillary action in drawing the liquid ammonia refrigerant up onto the inside facing surface of the evaporator tube.

25. A direct expansion ammonia refrigeration system as claimed in claim 16, and wherein the wicking structure comprises a wire mesh which is telescopingly received within and substantially juxtaposed against the inside facing surface of the evaporator tube, and which is effective by capillary action in drawing the liquid ammonia refrigerant up onto the inside facing surface of the evaporator tube.

26. A direct expansion ammonia refrigeration system as claimed in claim 21, and wherein the wicking structure comprises a sintered metal coating deposited upon the inside facing surface of the evaporator tube, and which is effective in drawing the liquid ammonia refrigerant up onto the inside facing surface of the evaporator tube by capillary action.

27. A direct expansion ammonia refrigerant system, comprising:

a source of a substantially non-aqueous liquid ammonia refrigerant;

a direct expansion ammonia evaporator having a plurality of evaporator tubes coupled in sequential gravity-feeding relation one to the others, and in fluid receiving relation relative to the source of liquid ammonia refrigerant, and wherein each of the evaporator tubes has an inside facing surface which defines individual refrigerant passageways, and wherein the inside facing surface of-at least one of the plurality evaporator tubes incorporates a wicking structure within the refrigerant passageway, and which, by capillary action, effectively draws, at least in part, the liquid ammonia refrigerant entering the refrigerant passageway along the inside facing surface so as to reduce any stratified and/or wavy flow patterns of the liquid ammonia refrigerant as it moves within the at least one of the plurality of evaporator tubes, and wherein the substantially non-aqueous liquid ammonia refrigerant leaves the respective evaporator tubes as substantially aqueous liquid ammonia and/or ammonia vapor;

an accumulator vessel defining an internal cavity, and which has a liquid region, and a vapor region, and wherein the vapor region further defines a fluid intake which is coupled in fluid receiving relation relative to the plurality of evaporator tubes, and wherein the liquid region receives and contains the aqueous liquid ammonia received from the plurality of evaporator tubes;

a heat exchanger vessel coupled in fluid receiving relation relative to the liquid region of the accumulator vessel, and is further coupled in fluid delivering relation relative to the vapor region of the accumulator vessel, and wherein the heat exchanger vessel includes a heating element which, when energized, vaporizes the aqueous liquid ammonia so as to deliver a substantially dry ammonia vapor to the vapor region of the accumulator vessel, and produce an acceptably concentrated aqueous ammonia byproduct; and a compressor coupled in fluid receiving relation relative to the vapor region of the accumulator vessel, and in fluid delivering relation relative to the plurality of evaporator tubes, and wherein the substantially dry ammonia vapor from the vapor region of the accumulator vessel is delivered to the compressor for conversion back to a substantially non-aqueous liquid ammonia refrigerant, and wherein the compressor provides the source of the substantially non-aqueous liquid ammonia refrigerant to the direct expansion ammonia evaporator.

28. A direct expansion ammonia refrigerant system as claimed in claim 27, and further comprising:

an oil separator coupled in fluid flowing relation therebetween the compressor and the direct expansion ammonia evaporator and which is effective to substantially remove any oil from the liquid ammonia refrigerant before the liquid ammonia refrigerant reaches the evaporator tubes.

29. A direct expansion ammonia refrigerant system as claimed in claim 27, and wherein the direct expansion ammonia evaporator further comprises:

a thermostatic expansion valve positioned downstream of the compressor, and which monitors the temperature and the pressure of the liquid ammonia refrigerant being delivered to the plurality of evaporator tubes; and a distributor positioned downstream of the thermostatic expansion valve and upstream relative to the plurality of evaporator tubes, and wherein the thermostatic expansion valve selectively controls the quantity of liquid ammonia refrigerant entering the distributor, based, at least in part, upon the temperature and pressure of the liquid ammonia refrigerant, and wherein the distributor distributes the liquid ammonia refrigerant among the plurality of evaporator tubes.

30. A direct expansion ammonia refrigeration system as claimed in claim 27, and wherein the wicking structure comprises a multiplicity of helical grooves formed into the inside facing surface of the evaporator tubes, and which are dimensioned so as to draw the liquid ammonia refrigerant up onto the inside facing surface of the respective evaporation tubes by capillary action.

31. A direct expansion ammonia refrigeration system as claimed in claim 27, and wherein the wicking structure comprises a multiplicity of cross-hatched knurls formed into the inside facing surface of the evaporator tube, and which are dimensioned so as to draw the liquid ammonia refrigerant up onto the inside facing surface of the respective evaporation tubes by capillary action.

32. A direct expansion ammonia refrigeration system as claimed in claim 27, and wherein the heating element mounted within the heat exchanger vessel is an electric resistance heater.

33. A direct expansion ammonia refrigeration system as claimed in claim 27, and wherein the heating element mounted within the heat exchanger vessel is a warm liquid heat exchanger.

34. A direct expansion ammonia refrigeration system as claimed in claim 27, and wherein the accumulator vessel has a minimum and a maximum aqueous liquid ammonia level.

35. A direct expansion ammonia refrigeration system as claimed in claim 34, and further comprising:

a liquid transfer vessel coupled in fluid flowing relation relative to the accumulator vessel, and which regulates the aqueous liquid ammonia level of the accumulator vessel; and a first fluid conduit having a first end coupled in fluid flowing relation relative to the accumulator vessel, and a second end coupled in fluid flowing relation relative to the liquid transfer vessel, and wherein the first end is positioned above the minimum aqueous liquid ammonia level and below the maximum aqueous liquid ammonia level of the accumulator vessel.

36. A direct expansion ammonia refrigeration system as claimed in claim 35, and further comprising:

a high pressure receiver which is coupled in fluid flowing relation relative to the liquid transfer vessel;

a plurality of solenoid valves positioned in selective fluid metering relation therebetween the accumulator vessel and the liquid transfer vessel, and between the liquid transfer vessel and the high pressure receiver; and a controller which is controllably coupled to the plurality of solenoid valves so as to selectively regulate the aqueous liquid ammonia level of the accumulator vessel.

37. A direct expansion ammonia refrigeration system as claimed in claim 34, and further comprising:

a second liquid level sensor mounted in liquid level sensing relation relative to the accumulator vessel, and which provides a signal relative to the aqueous liquid ammonia level;

a controller electrically coupled to the second liquid level sensor, and which receives the signal;

a liquid transfer pump which is controllably coupled to the controller, and which is further coupled in selective fluid flowing relation relative to the liquid region of the accumulator vessel; and a high pressure receiver, which is coupled in fluid flowing relation relative to the liquid transfer pump, and wherein the controller selectively controls the liquid transfer pump to transfer aqueous liquid ammonia between the accumulator vessel and the high pressure receiver, based, at least in part, upon the signal received from the second liquid level sensor, and so as to effectively control the accumulator vessel aqueous liquid ammonia level.

38. A method of direct expansion ammonia refrigeration, comprising;

providing a source of a substantially non-aqueous liquid ammonia;

providing a liquid ammonia expansion evaporator;

supplying the source of substantially non-aqueous liquid ammonia to the liquid ammonia expansion evaporator;

providing a compressor coupled in upstream fluid flowing relation relative to the liquid ammonia expansion evaporator, and in downstream fluid flowing relation relative to the source of the substantially non-aqueous liquid ammonia;

providing an accumulator vessel defining an internal cavity with a liquid region and a vapor region, and wherein the vapor region is coupled in downstream fluid flowing relation relative to the direct expansion ammonia evaporator, and is further coupled in upstream fluid flowing relation relative to the compressor;

providing a heat exchanger vessel coupled in downstream fluid flowing relation relative to the liquid region of the accumulator vessel, and in upstream fluid flowing relation relative to the vapor region of the accumulator vessel, and wherein the heat exchanger vessel further includes a heating element;

collecting any aqueous liquid ammonia and any ammonia vapor from the liquid ammonia expansion evaporator into the accumulator vessel, and wherein the ammonia vapor collects in the vapor region of the accumulator vessel, and the aqueous liquid ammonia collects in the liquid region of the accumulator vessel;

transferring the aqueous liquid ammonia from the liquid region of the accumulator vessel to the heat exchanger vessel;

heating the aqueous liquid ammonia in the heat exchanger vessel to vaporize at least some of the liquid ammonia, and producing a substantially dry ammonia vapor, while leaving an acceptably concentrated aqueous ammonia byproduct in the heat exchanger vessel;

returning the substantially dry vaporized ammonia to the vapor region of the accumulator vessel; and delivering the substantially dry vaporized ammonia from the vapor region of the accumulator vessel to the compressor.

39. The method as claimed in claim 38, and wherein before the step of collecting any aqueous liquid ammonia, the method further comprises:

compressing the substantially dry ammonia vapor delivered from the vapor region of the accumulator vessel with the compressor to form, at least in part, the source of the substantially non-aqueous ammonia liquid, before the step of supplying the substantially non-aqueous ammonia liquid to the liquid ammonia expansion evaporator; and after the step of supplying the substantially non-aqueous ammonia liquid to the liquid ammonia evaporator, boiling all or a substantial quantity of the non-aqueous ammonia liquid within the liquid ammonia expansion evaporator to produce aqueous liquid ammonia and any ammonia vapor.

40. The method as claimed in claim 39, and further comprising:

removing any acceptably concentrated aqueous ammonia byproduct remaining in the heat exchanger vessel.

41. The method as claimed in claim 40, and further comprising:

providing a drain solenoid valve for metering the removal of any acceptably concentrated aqueous ammonia byproduct from the heat exchanger vessel;

providing a controller which is electrically coupled to the drain solenoid, and which controls the operation of the drain solenoid valve;

sensing the level of the aqueous liquid ammonia within the heat exchanger vessel and producing a signal to the controller; and controlling the level of the aqueous liquid ammonia within the heat exchanger vessel by operating the drain solenoid valve in response to the sensing.

42. The method as claimed in claim 39, and further comprising:

providing an oil separator which is fluid flowingly coupled intermediate the compressor and the liquid ammonia expansion evaporator; and removing substantially any oil from the source of the non-aqueous liquid ammonia before the non-aqueous liquid ammonia reaches the liquid ammonia expansion evaporator.

43. A method of direct expansion ammonia refrigeration, comprising:

a) providing a source of a substantially non-aqueous liquid ammonia refrigerant;

b) providing a liquid ammonia expansion evaporator, which has a plurality of evaporator tubes coupled in fluid flowing relation relative to the source of the substantially non-aqueous liquid ammonia refrigerant, and wherein each of the plurality of evaporator tubes has an inside facing surface, which has a wicking structure;

c) supplying the substantially non-aqueous liquid ammonia refrigerant to the plurality of evaporator tubes;

d) drawing the substantially non-aqueous liquid ammonia refrigerant up onto the inside facing surface of the respective evaporator tubes with capillary action which is facilitated by the wicking structure;

e) boiling the substantially non-aqueous liquid ammonia refrigerant within the respective evaporator tubes to produce aqueous ammonia refrigerant and/or ammonia refrigerant vapor;

f) providing a compressor coupled in upstream fluid flowing relation relative to the liquid ammonia expansion evaporator, and which supplies the substantially non-aqueous liquid ammonia refrigerant to the plurality of evaporator tubes;

g) providing an accumulator vessel defining an internal cavity with a liquid region and a vapor region, and wherein the vapor region is coupled in downstream fluid flowing relation relative to the direct expansion ammonia evaporator, and is further coupled in upstream fluid flowing relation relative to the compressor;

h) providing a heat exchanger vessel coupled in fluid receiving relation relative to the liquid region of the accumulator vessel, and which is further coupled in fluid delivering relation relative to the vapor region of the accumulator vessel, and wherein the heat exchanger vessel includes a heating element;

i) collecting any aqueous liquid ammonia and/or any ammonia vapor from the liquid ammonia expansion evaporator into the accumulator vessel, and wherein the ammonia vapor collects in the vapor region of the accumulator vessel, and the aqueous liquid ammonia collects in the liquid region of the accumulator vessel;

j) transferring the aqueous liquid ammonia from the liquid region of the accumulator vessel to the heat exchanger vessel;

k) energizing the heating element so as to heat the aqueous liquid ammonia in the heat exchanger vessel and to vaporize at least some of the liquid ammonia to form substantially dry ammonia vapor while leaving an acceptably concentrated aqueous ammonia liquid byproduct in the heat exchanger vessel;

l) returning the substantially dry ammonia vapor to the vapor region of the accumulator vessel;

m) supplying the substantially dry ammonia vapor received in the vapor region of the accumulator vessel to the compressor so as to be subsequently converted to substantially non-aqueous liquid ammonia refrigerant; and n) repeating steps c through k.

44. The method as claimed in claim 43, and further comprising:

providing an oil separator coupled in fluid flowing relation intermediate the compressor and the liquid ammonia expansion evaporator; and removing substantially any oil from the liquid ammonia refrigerant before the liquid ammonia reaches the evaporator tubes.

45. The method as claimed in claim 43, and after step k, the method further comprises:

sensing the temperature of the acceptably concentrated aqueous ammonia liquid byproduct; and draining the acceptably concentrated aqueous ammonia liquid byproduct from the heat exchanger vessel.

46. The method as claimed in claim 43, and wherein step c further comprises, delivering the substantially non-aqueous liquid ammonia refrigerant to a highest point of the plurality of evaporator tubes; and wherein after step e the method further comprises removing the aqueous ammonia refrigerant and/or ammonia refrigerant vapor from a lowest point of the plurality of evaporator tubes.

* * * * *